US009153851B2

(12) United States Patent
Nakamura et al.

(10) Patent No.: US 9,153,851 B2
(45) Date of Patent: Oct. 6, 2015

(54) WAVEGUIDE CONVERTER

(71) Applicant: FUJITSU LIMITED, Kawasaki-shi (JP)

(72) Inventors: Satoshi Nakamura, Oyama (JP); Yoji Ohashi, Fucyu (JP); Toshihiro Shimura, Yokohama (JP); Takenori Ohshima, Isehara (JP); Keiichi Oguro, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 245 days.

(21) Appl. No.: 13/767,939

(22) Filed: Feb. 15, 2013

(65) Prior Publication Data

US 2013/0214871 A1 Aug. 22, 2013

(30) Foreign Application Priority Data

Feb. 20, 2012 (JP) ..... 2012-034062

(51) Int. Cl.
*H01P 5/107* (2006.01)
*H01P 1/16* (2006.01)

(52) U.S. Cl.
CPC . *H01P 1/16* (2013.01); *H01P 5/107* (2013.01)

(58) Field of Classification Search
USPC ..... 333/26, 33; 343/77
See application file for complete search history.

(56) References Cited

U.S. PATENT DOCUMENTS

| | | | | |
|---|---|---|---|---|
| 5,245,745 | A | 9/1993 | Jensen et al. | |
| 7,463,109 | B2 | 12/2008 | Iio | |
| 7,498,896 | B2 * | 3/2009 | Shi | 333/26 |
| 8,008,997 | B2 | 8/2011 | Cho | |
| 8,643,564 | B2 * | 2/2014 | Shimayama et al. | 343/850 |
| 2011/0037530 | A1 * | 2/2011 | Mangalahgari et al. | 333/26 |
| 2011/0050356 | A1 | 3/2011 | Nakamura et al. | |

FOREIGN PATENT DOCUMENTS

| | | | |
|---|---|---|---|
| EP | 1986265 | A1 | 10/2008 |
| EP | 2293380 | A1 | 3/2011 |
| JP | 5-90806 | A | 4/1993 |
| JP | 2010-87651 | A | 4/2010 |
| JP | 2011-55377 | | 3/2011 |
| JP | 2011-61290 | A | 3/2011 |
| JP | 2011-229107 | | 11/2011 |

OTHER PUBLICATIONS

Extended European Search Report dated May 28, 2013 for corresponding European Application No. 13155296.0.

JPOA—Japanese Office Action (Notice of Rejection Grounds) dated Aug. 11, 2015 for corresponding Japanese application No. 2012-034062, with partial English translation.

* cited by examiner

*Primary Examiner* — Dinh Le
(74) *Attorney, Agent, or Firm* — Fujitsu Patent Center

(57) ABSTRACT

A waveguide converter includes a waveguide including a hollow section through which a signal is transmitted and a first opening formed on a cross section of the hollow section in a direction orthogonal to a transmission direction of the signal, and a circuit board including on a same surface a signal line, a conductor patch connected to the signal line, and a second opening surrounding the conductor patch. The waveguide is fixed onto the circuit board. The first opening surrounds the second opening. The conductor patch includes a rectangular section which has short sides in parallel with short sides of the first opening, and has a first long side and a second long side connected to the signal line in parallel with long sides of the first opening, and protruding portions which are provided so as to touch the short sides near both ends of the second long side, respectively.

4 Claims, 32 Drawing Sheets

| Yr (um) | Xr (um) | L (um) |
|---|---|---|
| 910 | 1850 | 2760 |
| 920 | 1850 | 2770 |
| 930 | 1850 | 2780 |

FIG. 8

| | Y | X | $Y_1$ | $X_1$ | L' |
|---|---|---|---|---|---|
| SET VALUE $S_1$ | 905um | 1775um | 75um | 75um | 2830um |
| SET VALUE $S_2$ | 895um | 1725um | 100um | 100um | 2820um |
| SET VALUE $S_3$ | 885um | 1675um | 125um | 125um | 2810um |

FIG. 19

WAVEGUIDE CONVERTER

CROSS-REFERENCE TO RELATED APPLICATIONS

This application is based upon and claims the benefit of priority of the prior Japanese Patent Application No. 2012-034062, filed on Feb. 20, 2012, the entire contents of which are incorporated herein by reference.

FIELD

The embodiments discussed herein are related to a waveguide converter that converts the transmission mode of a signal between a wave guide and a transmission line of a circuit board.

BACKGROUND

When a signal whose band has a short wavelength, such as millimeter waves or microwaves, which is typically used for car radar and high-seed wireless communication system, is transmitted from and received at an antenna by using a transmitter-receiver circuit, a waveguide may be connected between the transmitter-receiver circuit and the antenna.

The transmitter-receiver circuit is integrated, for example, as a monolithic microwave integrated circuit (MMIC), and a planar transmission line such as a microstrip line and a coplanar line is used for a transmission line on the transmitter-receiver circuit side. The transmission mode of a signal is different between such a transmission line on a transmitter-receiver circuit side and a waveguide. Thus, when a waveguide is connected between a transmitter-receiver circuit and an antenna, a waveguide converter is used to convert the transmission mode so as to be suitable for the transmission line on a transmitter-receiver circuit side and the waveguide, respectively.

In regard to waveguide converters, the following related art is known. That is, a microstrip line—waveguide converter is comprised of a waveguide, a first conductor layer, a dielectric substrate, and a ground conductor layer. The first conductor layer is comprised of a microstrip line that has a patch pattern formed on an end, a ground conductor pattern that surrounds the patch pattern, and via holes that connect the ground conductor pattern and the ground conductor layer. Then, the waveguide, the first conductor layer, the dielectric substrate, and the ground conductor layer are stacked from the top in the listed order at a position where the center of the opening of a waveguide and the center of the patch pattern overlap with each other. A number of via holes are formed so as to surround the periphery of the opening of the waveguide.

Moreover, the following related art is also known. That is, a waveguide/strip line converter is provided with: a dielectric substrate having a first surface that closes the rectangular opening of a waveguide; a shorting plate formed on a second surface of a dielectric substrate to short the waveguide; a matching element formed on a first surface of the dielectric substrate; and a strip line that is formed in an incision of the shorting plate and is electromagnetically coupled to the matching element. The matching element is shaped so as to surround a non-formation area, and has an asymmetrical shape with reference to a direction parallel to the long sides of the opening.

Furthermore, the following related art is also known. That is, a waveguide/strip line converter is comprised of a rectangular waveguide and a dielectric substrate. An aperture for guiding an electromagnetic wave is arranged on one end of the rectangular waveguide, and an end surface is arranged on the other end. The dielectric substrate is inserted into the rectangular waveguide from the side of the dielectric substrate in such a manner that the dielectric substrate exists in a direction orthogonal to the end surface of the rectangular waveguide and the mounted position viewed from the opening is at approximately the center of the aperture. Moreover, an approximately cross-shaped conductor pattern is arranged on the dielectric substrate, and one side of the conductor pattern is extended as a pattern to draw out a signal to the outside of the rectangular waveguide. The pattern to draw out a signal is formed as a strip line outside the rectangular waveguide. The electric field of an electromagnetic wave that is guided into the rectangular waveguide is coupled to the conductor pattern, and is converted to an electric signal by the conductor pattern and transmitted to the strip line.

The waveguide converter includes a conductor patch. The conductor patch has the function of emitting a signal that is transmitted through the transmission line on a transmitter-receiver circuit side to the waveguide, and has the function of emitting a signal that is transmitted through the waveguide to the transmission line on the transmitter-receiver circuit side.

It is necessary for the size of the conductor patch to be smaller than the opening of a waveguide that is determined according to an active frequency band. In order for the waveguide converter to achieve a good signal conversion performance in a desired frequency band, it is necessary to determine the shape and size of the conductor patch according to the wavelength of a signal determined by the dielectric constant or the like of the dielectric substrate that composes the transmission line on the transmitter-receiver circuit side.

When a rectangular-shaped conductor patch is provided for a waveguide converter, the waveguide converter may perform signal conversion in a desired active frequency if the length of sides of the conductor patch that is parallel with the transmission direction of a signal of the transmission line on the transmitter-receiver circuit side are set to be half the wavelength of the signal. However, half the wavelength of a signal that is transmitted through the dielectric substrate may be greater than the short sides of the opening of the waveguide when, for example, a low-level side of a recommended frequency band of the waveguide is used or when, for example, a dielectric substrate of a low dielectric constant is used. In order to achieve a good signal conversion performance in such a case by using a rectangular-shaped conductor patch, it is necessary for the shape of a conductor patch to be rectangular and longer in a direction of the long sides of the opening of the waveguide. However, depending on the length of the long sides of a conductor patch, a resonance that degrades the pass characteristic of a signal between the waveguide and the transmission line is caused near the active frequency band. For this reason, it is necessary to design the waveguide converter such that a resonance frequency that degrades the pass characteristic of the waveguide converter will not be caused near the active frequency band.

Moreover, when a resin whose pattern precision is poor is used, for example for the purpose of cost reduction, as a substrate material instead of ceramics, a pattern misalignment may be caused when a waveguide converter is manufactured.

FIG. 1 depicts the deterioration of a pass characteristic caused due to a pattern misalignment.

In FIG. 1, pass characteristics T1 and T2 of a waveguide converter are depicted with a scattering parameter S21 where a port 1 is on a waveguide side and a port 2 is on a transmission line side to which a transmitter-receiver circuit is connected.

As illustrated in FIG. 1, the pass characteristic T2 where pattern misalignment was caused when the waveguide converter was manufactured deteriorates at the center frequency of an active frequency band $f_c$ in comparison with the pass characteristic T1 where no pattern misalignment was caused. A resonance frequency $f_{r2}$ that degrades the pass characteristic T2 is closer to the center frequency of an active frequency band $f_c$ in comparison with a resonance frequency $f_{r1}$ that degrades the pass characteristic T1.

As described above, when a pass characteristic deteriorates at the center frequency of an active frequency band due to the pattern misalignment that was caused when the waveguide was manufactured, or when a resonance frequency that degrades the pass characteristic is misaligned and gets close to an active frequency band, a signal conversion performance of the waveguide converter deteriorates. Thus, it is necessary to design a waveguide converter in such a manner that the deterioration of a pass characteristic will be minimized and a required signal conversion performance will be secured even if the pattern precision of the waveguide converter at the time of manufacture is poor.

RELATED ART DOCUMENT

Patent Documents

[Patent Document 1]
Japanese Laid-open Patent Publication No. 2011-061290
[Patent Document 2]
Japanese Laid-open Patent Publication No. 2010-087651
[Patent Document 3]
Japanese Laid-open Patent Publication No. 05-090806

SUMMARY

According to an aspect of the embodiments, a waveguide converter includes a waveguide which includes a hollow section through which a signal is transmitted and a first opening formed on a cross section of the hollow section in a direction orthogonal to a transmission direction of the signal, and a circuit board which includes on a same surface a signal line, a conductor patch connected to the signal line, and a second opening surrounding the conductor patch. The waveguide is adhered and fixed onto the circuit board in such a manner that the first opening surrounds the second opening. The conductor patch includes a rectangular section and protruding portions. The rectangular section has short sides in a direction parallel to short sides of the first opening, and has a first long side and a second long side in a direction parallel to long sides of the first opening. The second long side is connected to the signal line. The protruding portions are provided so as to touch the short sides near both ends of the second long side, respectively.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 8 is a list of the sizes of a rectangular patch for which a simulation analysis is performed;

FIG. 19 is a list of the sizes of the conductor patch according to the first embodiment for which a simulation analysis is performed by fixing X' and increasing $X_1$, $Y_1$, X, and Y;

DESCRIPTION OF EMBODIMENTS

Some embodiments of the present invention will be described in detail with reference to the accompanying drawings.

First Embodiment

Figure 1:
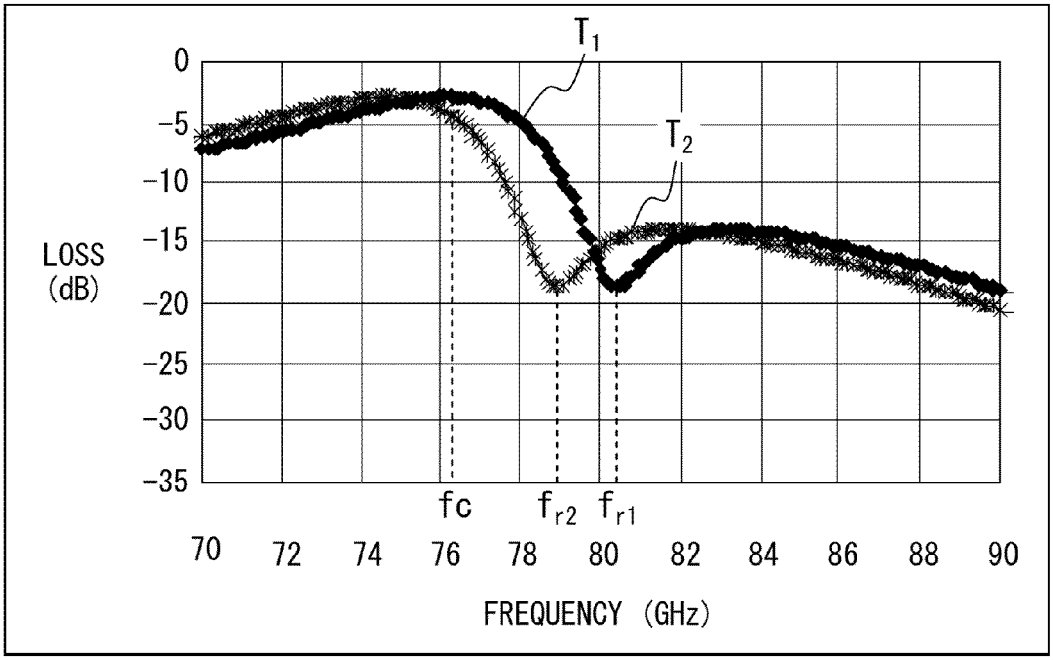
FIG. 1 depicts the deterioration of a pass characteristic caused by a pattern misalignment.
Figure 2:
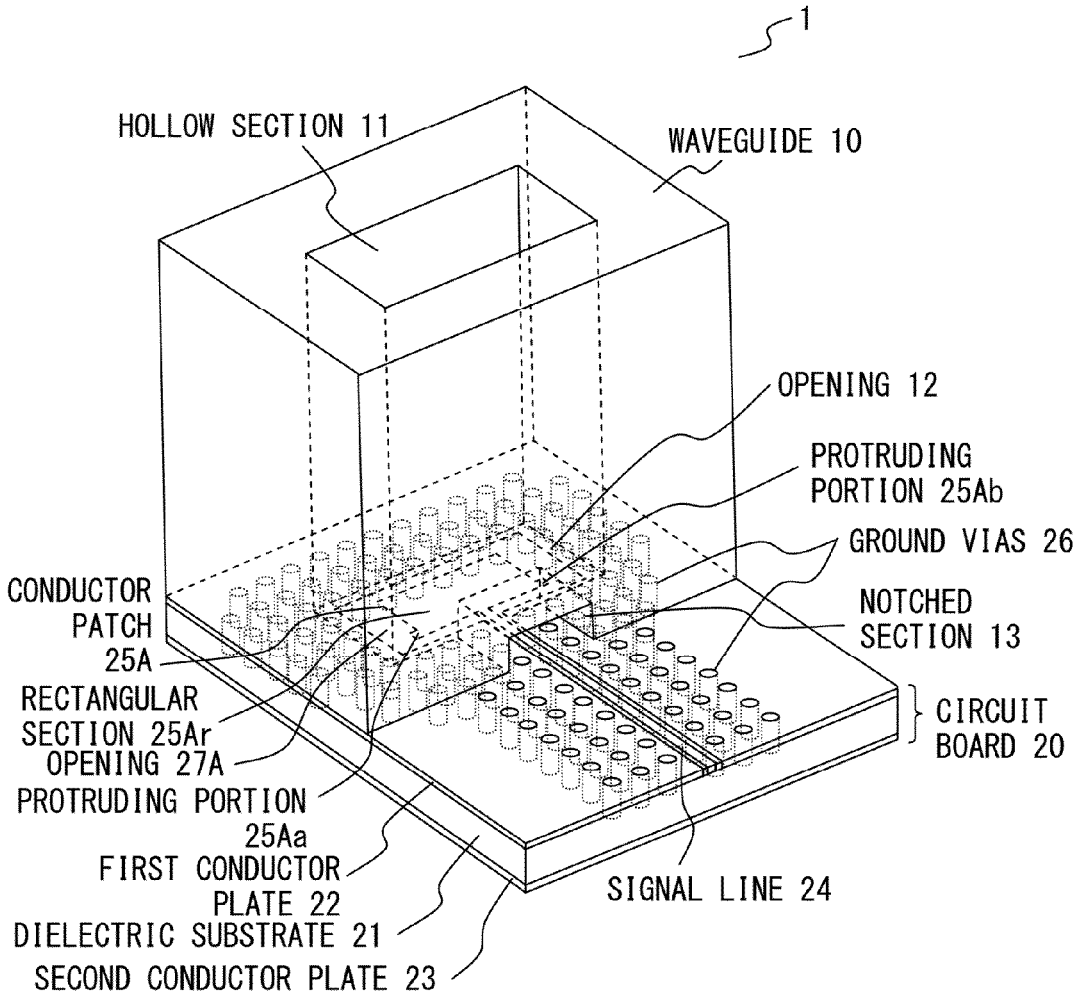
FIG. 2 is a perspective view of an example of the waveguide converter according to the first embodiment.
Figure 3:
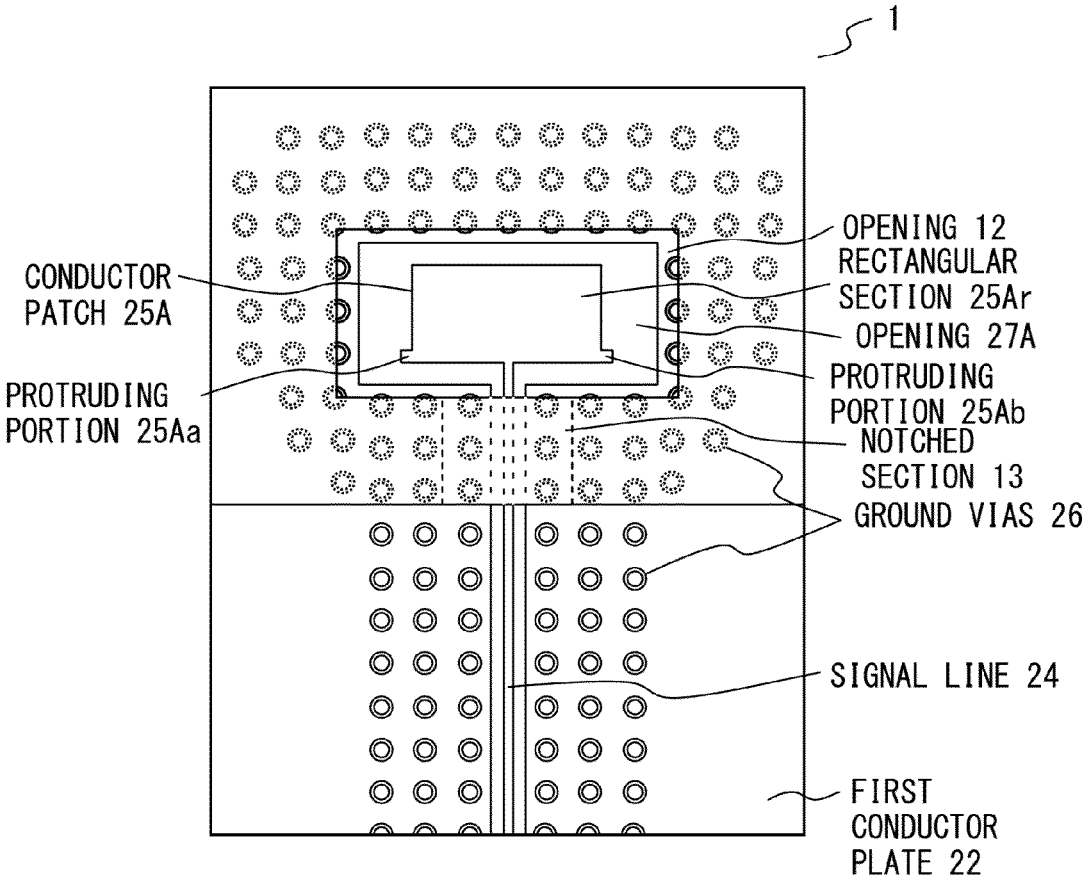
FIG. 3 is a top view of an example of the waveguide converter according to the first embodiment.

FIG. 2 is a perspective view of an example of the waveguide converter according to the first embodiment. FIG. 3 is a top view of an example of the waveguide converter according to the first embodiment.

As illustrated in FIG. 2, the waveguide converter 1 according to the first embodiment includes a waveguide 10 and a circuit board 20.

The waveguide 10 is a transmission line that transmits a signal (radio wave), and is disposed on the top surface of the circuit board 20 as illustrated in FIG. 2.

As illustrated in FIG. 2, the waveguide 10 includes a hollow section 11 in a square-tube shape surrounded by the conducting wall that constitutes the waveguide 10, and a signal is transmitted through the hollow section 11.

Moreover, an opening 12 is provided on one end of the waveguide 10 in the transmission direction of a signal. The opening 12 is formed by a cross section of the hollow section 11 in the direction orthogonal to the transmission direction of a signal. Note that an antenna (not illustrated) that emits and receives a high-frequency signal such as microwaves and millimeter waves may be connected to the other ends of the waveguide 10 at which the opening 12 does not exist.

The circuit board 20 includes a dielectric substrate 21, a first conductor plate 22, a second conductor plate 23, a signal line 24, a conductor patch 25A, and ground vias 26.

As illustrated in FIG. 2, the first conductor plate 22, the signal line 24, and the conductor patch 25A are provided on the top surface of the dielectric substrate 21. In other words, the first conductor plate 22, the signal line 24, and the conductor patch 25A are disposed on the same surface of the dielectric substrate 21. Moreover, the second conductor plate 23 is disposed on the undersurface of the dielectric substrate 21.

The signal line 24 is a transmission line provided for the circuit board 20, and is, for example, a microstrip line. As illustrated in FIG. 3, a certain distance of insulation space is provided between the first conductor plate 22 and the signal line 24, and a coplanar line is formed by the first conductor plate 22 and the signal line 24.

As illustrated in FIG. 2, a notched section 13 is provided on a side of the waveguide 10 at one end where the opening 12 is formed, and the signal line 24 within the opening 12 is drawn out from the waveguide 10 through the notched section 13.

The notched section 13 is shaped like a rectangular parallelepiped, and the undersurface of the notched section 13 touches the top surface of the first conductor plate 22. The width and height of the aperture plane of the notched section 13 in the direction in which the signal line 24 is drawn out from the waveguide 10 is set sufficiently smaller than half the wavelength calculated from the active frequency of a signal.

As illustrated in FIG. 3, an opening 27A that exposes the dielectric substrate 21 is provided on the first conductor plate 22. The shape of the outer edge of the opening 27A is similar to the shape of the edge of the opening 12, and the size of the opening 27A is smaller than the size of the opening 12. The end of the waveguide 10 that has the opening 12 is adhered and fixed onto the first conductor plate 22 in such a manner that the opening 12 surrounds the opening 27A.

Inside the opening 27A, the conductor patch 25A is provided with space so as to not be electrically continuous with the first conductor plate 22. As illustrated in FIG. 2, the conductor patch 25A is formed on the surface of the dielectric substrate 21 on which the signal line 24 is also formed, and the conductor patch 25A is connected to one end of the signal line 24.

Note that a transmitter-receiver circuit (not illustrated) of a high-frequency signal such as microwaves and millimeter waves may be connected to the other end of the signal line 24 that is not connected to the conductor patch 25A. Such a transmitter-receiver circuit may be integrated as a monolithic microwave integrated circuit.

As illustrated in FIG. 2 and FIG. 3, the conductor patch 25A according to the first embodiment includes a rectangular section 25Ar and protruding portions 25Aa and 25Ab.

The rectangular section 25Ar is a part of the conductor patch 25A, and is a rectangular-shaped portion of the conductor patch 25A. The protruding portions 25Aa and 25Ab are parts of the conductor patch 25A, and are protruding portions of the conductor patch 25A.

As illustrated in FIG. 2 and FIG. 3, the rectangular section 25Ar has short sides in the direction parallel with the transmission direction of a signal on the signal line 24, and has long sides in the direction orthogonal to the transmission direction of that signal. In other words, the rectangular section 25Ar has short sides in the same direction as that of the short sides of the hollow section 11 of the waveguide 10, and has long sides in the same direction as that of the long sides of the hollow section 11.

As illustrated in FIG. 2 and FIG. 3, the protruding portions 25Aa and 25Ab are provided on the short sides of the rectangular section 25Ar near both ends of the long side of the rectangular section 25Ar which is connected to the signal line 24.

The protruding portions 25Aa and 25Ab having a rectangular shape are depicted in FIG. 2 and FIG. 3, but the protruding portions 25Aa and 25Ab may be squares or rectangles. Moreover, the shape of the protruding portions 25Aa and 25Ab may be polygonal or circular instead of being rectangular.

When the protruding portions 25Aa and 25Ab are rectangular-shaped as illustrated in FIG. 2 and FIG. 3, sides of the protruding portions 25Aa and 25Ab exist in parallel with the short sides of the rectangular section 25Ar. Moreover, sides of the protruding portions 25Aa and 25Ab exist on the extension of the long side of the rectangular section 25Ar that is connected to the signal line 24, and the long side of the rectangular section 25Ar and these sides of the protruding portions 25Aa and 25Ab form a side of the conductor patch 25A that is connected to the signal line 24.

As illustrated in FIG. 3, the conductor patch 25A may be arranged in such a manner that a center line that vertically divides the long sides of the rectangular section 25Ar into two equal parts matches a center line that vertically divides the long sides of the opening 12 of the waveguide 10 into two equal parts. Moreover, the conductor patch 25A may be arranged in such a manner that the signal line 24 is connected onto a center line that vertically divides the long sides of the rectangular section 25Ar into two equal parts.

The ground vias 26 are coupling parts that electrically couple the first conductor plate 22 to the second conductor plate 23. As illustrated in FIG. 2 and FIG. 3, the ground vias 26 are formed under one end of the waveguide 10 that is adhered and fixed onto the first conductor plate 22, and are formed under the first conductor plate 22 that surrounds the signal line 24. The ground vias 26 are not formed under the signal line 24.

A method for determining the shape and size of the conductor patch 25A according to the first embodiment will be explained.

Figure 4:
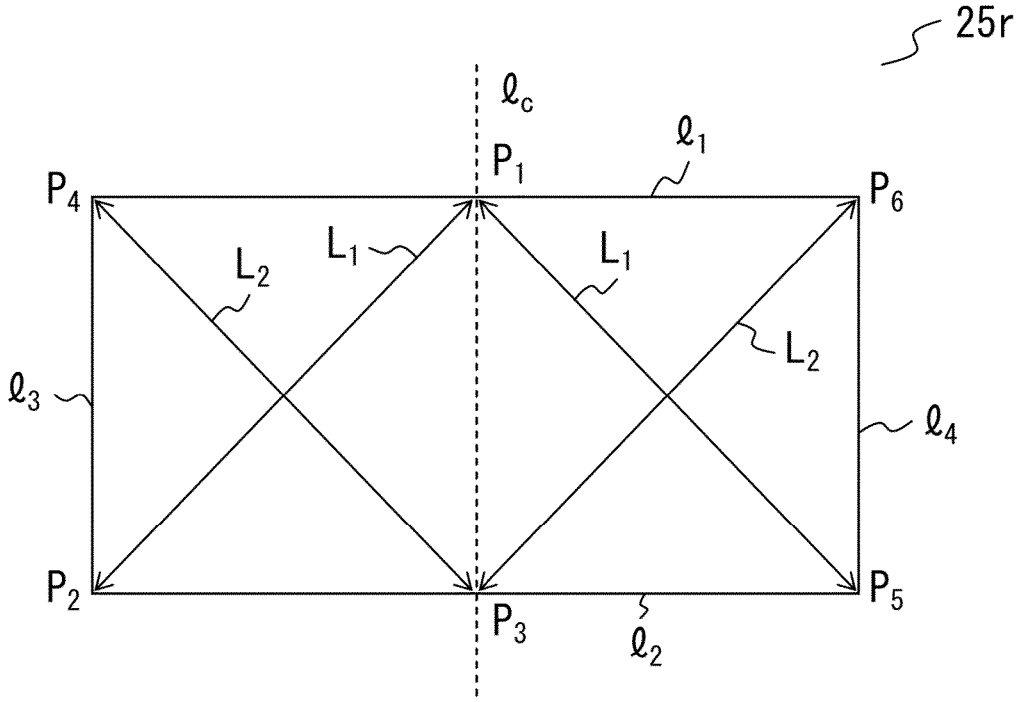
FIG. 4 is a drawing explaining the relationship between the shape of a rectangular patch and a frequency characteristic.

FIG. 4 is a drawing for explaining the relationship between the shape of a rectangular patch and a frequency characteristic.

A rectangular conductor patch 25*r* of FIG. 4 includes long sides $l_1$ and $l_2$, and short sides $l_3$ and $l_4$.

Here, it is assumed that the conductor patch 25*r* is provided as the conductor patch of the waveguide converter 1, instead of the conductor patch 25A including the protruding portions 25Aa and 25Ab. In other words, it is assumed that the conductor patch 25*r* is arranged within the opening 12 of the waveguide 10 such that the long side $l_1$ and $l_2$ will be parallel with the long sides of the waveguide 10 and the short sides $l_3$ and $l_4$ will be parallel with the short sides of the waveguide 10, and that the signal line 24 is connected to the long side $l_2$ which is illustrated at the bottom of FIG. 4. In this case, the relationship between the shape of the conductor patch 25*r* and a frequency characteristic is explained as below.

Firstly, an undesired resonance frequency in the waveguide converter that includes the conductor patch 25*r*, i.e., a resonance frequency that degrades the pass characteristic indicated by a scattering parameter S21 when it is assumed that a port 1 exists on the waveguide 10 side and a port 2 exists on the signal line 24 side, is determined according to the length of a straight line $L_1$ illustrated in FIG. 4.

The straight line $L_1$ is a straight line that is drawn from a point $P_1$ at which a center line $l_c$ that vertically divides the long sides $l_1$ and $l_2$ of the conductor patch 25*r* into two equal parts intersects with a long side $l_1$ at the top of FIG. 4 to a point $P_2$ at which a long side $l_2$ at the bottom of FIG. 4 intersects with a short side $l_3$. Also, the straight line $L_1$ is a straight line that is drawn from the intersection point $P_1$ to a point $P_5$ at which the long side $l_2$ at the bottom of FIG. 4 intersects with a short side $l_4$.

Next, the center frequency of an active frequency band in the waveguide converter that includes the conductor patch 25*r*, i.e., a resonance frequency that degrades the reflection characteristic indicated by scattering parameters S11 and S22, is determined according to the length of a straight line $L_2$.

The straight line $L_2$ is a straight line that is drawn from a point $P_3$ at which the center line $l_c$ intersects with the long side $l_2$ at the bottom of FIG. 4 to a point $P_4$ at which the long side $l_1$ at the top of FIG. 4 intersects with the short side $l_3$. Also, the straight line $L_2$ is a straight line that is drawn from the intersection point $P_3$ to a point $P_6$ at which the long side $l_1$ at the top of FIG. 4 intersects with the short side $l_4$.

The size of the rectangular conductor patch 25*r* and an undesired resonance frequency or an active center frequency are in a relationship such as that above. For this reason, when the length of the straight line $L_1$ is the same as the length of the straight line $L_2$ as in the conductor patch 25*r* of FIG. 4 for example, an undesired resonance frequency becomes close to the center frequency of an active frequency band. When an undesired resonance frequency becomes close to the center frequency of an active frequency band, the signal conversion performance of the waveguide deteriorates.

Figure 5:
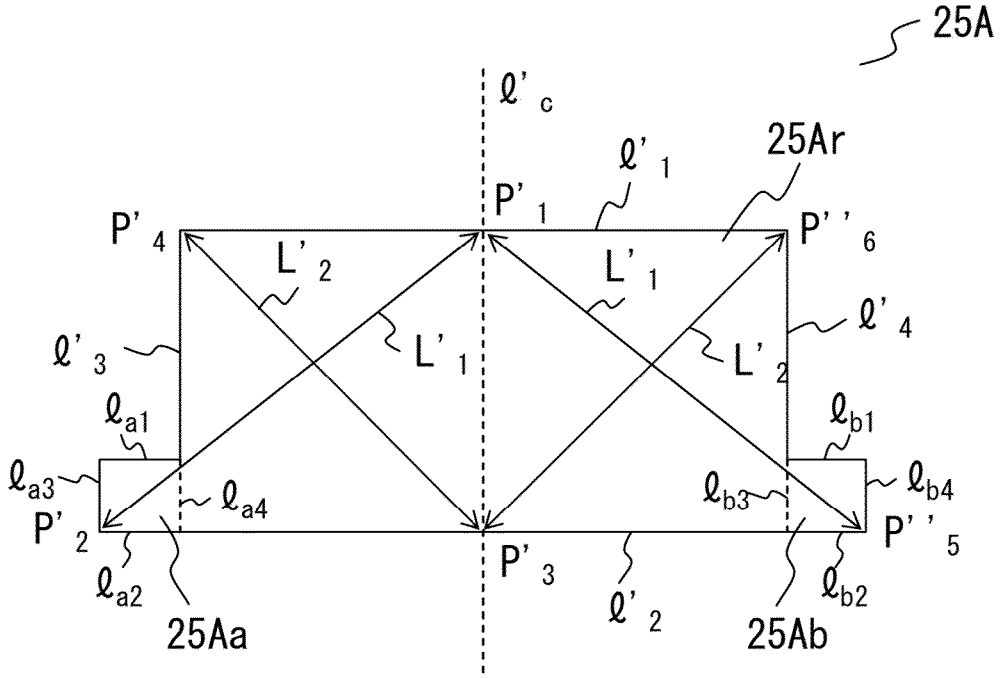
FIG. 5 is a drawing explaining the relationship between the shape of a conductor patch according to the first embodiment and a frequency characteristic.

Hence, in the first embodiment, the conductor patch 25A includes the rectangular section 25Ar and the protruding portions 25Aa and 25Ab as illustrated in FIGS. 2, 3, and 5 in order to keep an undesired resonance frequency away from the center frequency of an active frequency band.

FIG. 5 is a drawing for explaining the relationship between the shape of a conductor patch according to the first embodiment and a frequency characteristic.

In FIG. 5, the signal line 24 is connected to the long side $l_{2'}$ side of the rectangular section 25Ar at the bottom of FIG. 5, and the conductor patch 25A is arranged within the opening 12 of the waveguide 10.

The rectangular section 25Ar is provided with long sides $l_1$' and $l_{2'}$ and short sides $l_{3'}$ and $l_{4'}$. The long sides $l_{1'}$ and $l_{2'}$ are parallel with the long sides of the waveguide 10, and the short sides $l_{3'}$ and $l_{4'}$ are parallel with the short sides of the waveguide 10.

The protruding portion 25Aa includes sides $l_{a1}$-$l_{a4}$. The side $l_{a1}$ is parallel with the side $l_{a2}$, and the side $l_{a3}$ is parallel with the side $l_{a4}$. The protruding portion 25Ab includes sides $l_{b1}$-$l_{b4}$. The side $l_{b1}$ is parallel with the side $l_{b2}$, and the side $l_{b3}$ is parallel with the side $l_{b4}$.

The protruding portions 25Aa and 25Ab are arranged so as to touch the short sides of the rectangular section 25Ar near both ends of the long side $l_{2'}$ that is connected to the signal line 24. In other words, the protruding portion 25Aa is arranged so as to touch one end of the long side $l_{2'}$, where the side $l_{a4}$ overlaps with the short side $l_{3'}$. Also, the protruding portion 25Ab is arranged so as to touch one end of the long side $l_{2'}$, where the side $l_{b3}$ overlaps with the short side $l_{4'}$.

The side $l_{a3}$ of the protruding portion 25Aa and the side $l_{b4}$ of the protruding portion 25Ab exist in parallel with the short sides $l_{3'}$ and $l_{4'}$ of the rectangular section 25Ar. The side $l_{a2}$ of the protruding portion 25Aa and the side $l_{b2}$ of the protruding portion 25Ab exist on the extension of the long side $l_{2'}$ of the rectangular section 25Ar, and the long side $l_{2'}$ as well as side $l_{a2}$ and side $l_{b2}$ form the long side, which connects to the signal line 24, of the conductor patch 25A.

Firstly, an undesired resonance frequency in the waveguide converter 1 that includes the conductor patch 25A of FIG. 5, i.e., a resonance frequency that degrades the pass characteristic indicated by the scattering parameter S21 when it is assumed that a port 1 exists on the waveguide 10 side and a port 2 exists on the signal line 24 side, is determined according to the length of a straight line $L_{1'}$ illustrated in FIG. 5.

The straight line $L_{1'}$ is a straight line that is drawn from a point $P_{1'}$ at which a center line $l_{c'}$ that vertically divides the long sides $l_{1'}$ and $l_{2'}$ of the rectangular section 25Ar into two equal parts intersects with the long side $l_{1'}$ at the bottom of FIG. 5 to a point $P_{2'}$ at which a side $l_{a3}$ of the protruding portion 25Aa that is parallel with the short side $l_{3'}$ and that does not touch the rectangular section 25Ar intersects with a side $l_{a2}$ of the protruding portion 25Aa on the extension of the long side $l_{2'}$. Also, the straight line $L_{1'}$ is a straight line that is drawn from the intersection point $P_{1'}$ to a point $P_{5'}$ at which a side $l_{b4}$ of the protruding portion 25Ab that is parallel with the short side $l_{4'}$ and that does not touch the rectangular section 25Ar intersects with a side $l_{b2}$ of the protruding portion 25Ab on the extension of the long side $l_{2'}$.

Next, the center frequency of an active frequency band in the waveguide converter 1 that includes the conductor patch 25A, i.e., a resonance frequency that degrades the reflection characteristic indicated by scattering parameters S11 and S22, is determined according to the length of a straight line $L_{2'}$.

The straight line $L_{2'}$ is a straight line that is drawn from a point $P_{3'}$ at which the center line $l_{c'}$ intersects with the long side $l_{2'}$ at the bottom of FIG. 5 to a point $P_{4'}$ at which the long side $l_{1'}$ at the top of FIG. 5 intersects with the short side $l_{3'}$. Also, the straight line $L_{2'}$ is a straight line that is drawn from the intersection point $P_{3'}$ to a point $P_{6'}$ at which the long side $l_{1'}$ at the top of FIG. 5 intersects with the short side $l_{4'}$.

As illustrated in FIG. 5, the protruding portion 25Aa is provided for the conductor patch 25A according to the first embodiment so as to touch the short side $l_{3'}$ at one end of the long side $l_{2'}$. Moreover, the protruding portion 25Ab is provided for the conductor patch 25A so as to touch the short side $l_{4'}$ at the other end of the long side $l_{2'}$. Accordingly, it becomes possible to make the straight line L' that determines an undesired resonance frequency be longer than the straight line L2' that determines the center frequency of an active frequency band due to the existence of the protruding portions 25Aa and 25Ab. When the straight line $L_{1'}$ is made longer than the straight line $L_{2'}$, it is possible to shift an undesired resonance frequency to a high frequency, and thus it becomes possible to keep an undesired resonance frequency away from the center frequency of an active frequency band.

Accordingly, the waveguide converter 1 that is provided with the conductor patch 25A according to the first embodiment may achieve a good signal conversion performance in an active frequency band. Moreover, it is possible to secure a good signal conversion performance in the active frequency band even if a pattern misalignment is caused when a waveguide converter is manufactured because it is possible to keep an undesired resonance frequency away from the center frequency of an active frequency band.

Furthermore, the conductor patch 25A according to the first embodiment is formed in such a manner that the length of the short sides and long sides of the rectangular section 25*r* excluding the protruding portions 25Aa and 25Ab becomes shorter than the length of the short sides and long sides of the conductor patch 25*r* of FIG. 4. In other words, when the center frequency of an active frequency band is the same between the waveguide converter 1 provided with the conductor patch 25A and the waveguide converter provided with the conductor patch 25*r*, the long sides $l_{1'}$ and $l_{2'}$ are shorter than the long sides $l_1$ and $l_2$, the short sides $l_{3'}$ and $l_{4'}$ are shorter than the short sides $l_3$ and $l_4$, and the size of the rectangular section 25Ar is smaller than the size of the conductor patch 25*r*. The center frequency of an active frequency band is moved as the shape of a conductor patch becomes no longer rectangular due to the provision of the protruding portions 25Aa and 25Ab, and thus it becomes necessary to adjust the length of $L_{2'}$. For this reason, the size of the conductor patch 25A is smaller than the size of the conductor patch 25*r* as described above.

An example of the method for determining the shape and size of the conductor patch 25A according to the first embodiment by using an electromagnetic field simulation will be described below. It will be described below that the waveguide converter 1 provided with the conductor patch 25A according to the first embodiment has a good signal conversion performance in comparison with the waveguide converter that includes the rectangular conductor patch 25*r* as illustrated in FIG. 4.

Note that the example described below is only for explaining a method of determining the shape and size of the conductor patch 25A and demonstrating an advantageous effect of the waveguide converter 1 that is provided with the conductor patch 25A. In other words, a method for determining the shape and size of the conductor patch 25A and an advantageous effect of the waveguide converter 1 are not limited to the specific numeric values described in the example below.

Firstly, a result of the simulation analysis of a signal conversion performance in the case where the rectangular conductor patch 25*r* is provided for the waveguide converter 1 instead of the conductor patch 25A will be described in comparison with a signal conversion performance in the case where the conductor patch 25A is provided for the waveguide.

Figure 6:
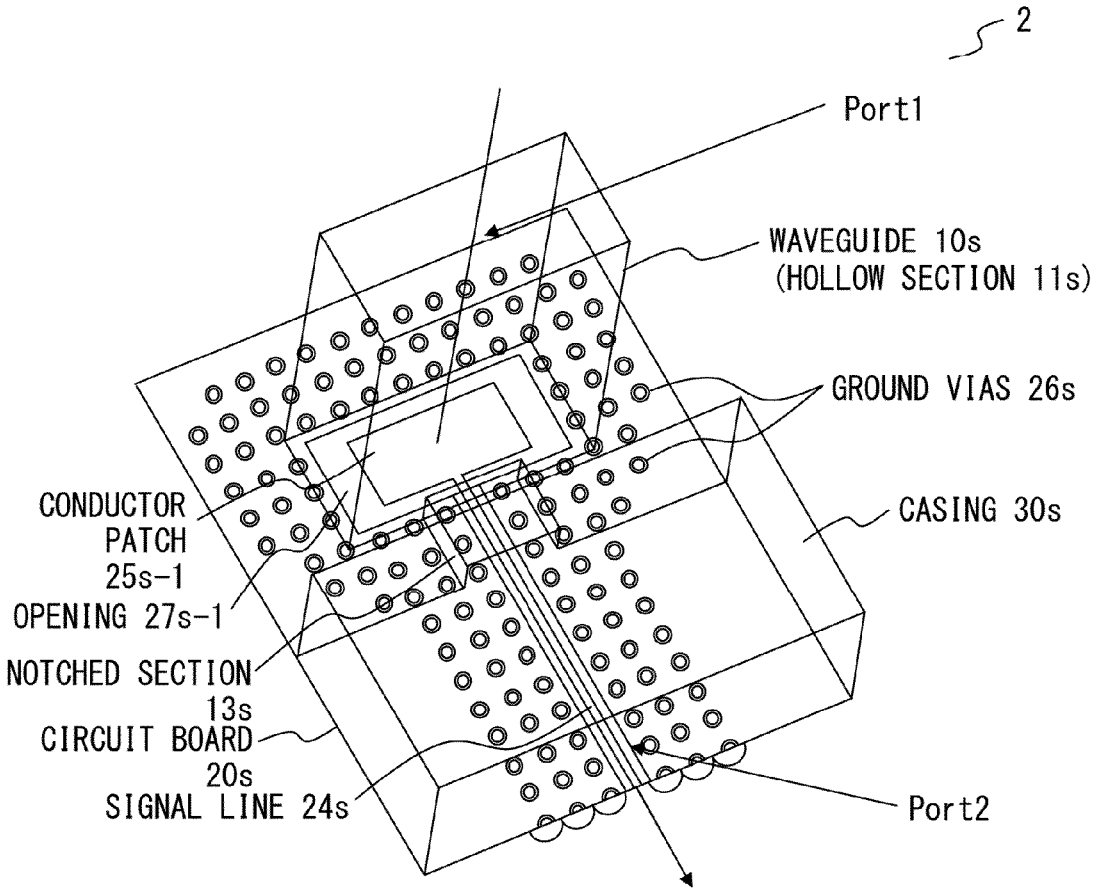
FIG. 6 is a perspective view of a simulation model of a waveguide converter that is provided with a rectangular patch.
Figure 7:
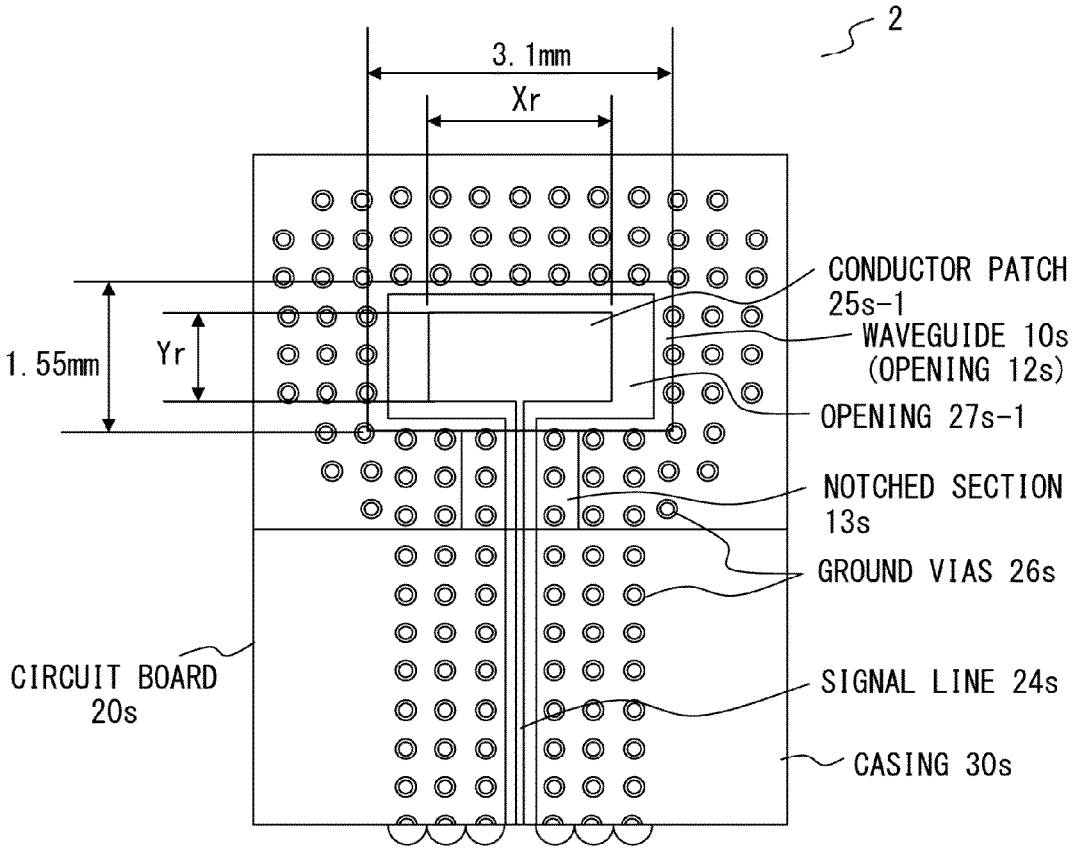
FIG. 7 is a top view of a simulation model of a waveguide converter that is provided with a rectangular patch.

FIG. 6 is a perspective view of a simulation model of a waveguide converter that is provided with a rectangular patch. FIG. 7 is a top view of a simulation model of a waveguide converter that is provided with a rectangular patch. FIG. 8 is a list of the sizes of a rectangular patch for which a simulation analysis is performed.

A simulation model 2 of the waveguide converter illustrated in FIG. 6 and FIG. 7 is a simulation model of the waveguide converter that is provided with the rectangular conductor patch 25*r* instead of the conductor patch 25A.

A waveguide 10*s* illustrated in FIG. 6 and FIG. 7 corresponds to the waveguide 10. In the simulation model 2 of the waveguide converter illustrated in FIG. 6 and FIG. 7, a hollow section 11*s* that corresponds to the hollow section 11 and an opening 12*s* that corresponds to the opening 12 are set as a model of the waveguide 10*s*.

A circuit board 20*s* corresponds to the circuit board 20. A signal line 24*s* corresponds to the signal line 24. Ground vias 26*s* correspond to the ground vias 26.

A conductor patch 25*s*-1 corresponds to the rectangular patch 25*r* as illustrated in FIG. 4. The conductor patch 25*s*-1 is arranged within the opening 27*s*-1 of the circuit board 20*s*.

The conductor patch 25*s*-1 has a rectangular shape, where the short sides are parallel with the transmission direction of a signal from the signal line 24*s*, and the long sides are orthogonal to the transmission direction of the signal. In other words, as illustrated in FIG. 7, the conductor patch 25*s*-1 has the short sides in the same direction as the short sides of the opening 12*s*, and has the long sides in the same direction as the long sides of the opening 12*s*.

In FIG. 6 and FIG. 7, a casing 30*s* is illustrated that covers the signal line 24*s* that extends outside the waveguide 10*s* from the notched section 13*s* that corresponds to the notched section 13, and that is disposed on the circuit board 20*s*. The casing 30*s* is an element that is expediently provided for the simulation model 2 of the waveguide converter in order to analyze the behavior of an electromagnetic field by using an electromagnetic field simulation.

As illustrated in FIG. 6, a port 1 to which a signal is incident and reflected is on the waveguide 10*s* side, and a port 2 to which a signal is incident and reflected is on the signal line 24*s* side.

As set values for an electromagnetic field simulation, it is assumed that the relative permittivity ∈r and the thickness of a dielectric substrate included in the circuit board 20*s* are 4.1 and 60 (μm), respectively. Moreover, it is assumed that a dielectric loss tangent tan δ is 0.015. It is assumed that the conductivity and the thickness of the first and second conductor plates included in the circuit board 20*s* are 5.8 e7 (s/m) and 37 (μm), respectively. It is assumed that the pitch of the ground vias 26*s* is 400 (μm). It is assumed that the line width of the signal line 24*s* is 100 (μm), and that the insulation space between the signal line 24*s* and the first conductor plate is 100 (μm).

Moreover, the length of the long sides of the opening 12*s* of the waveguide 10*s* is set to 3.1 (mm), and the length of the short sides is set to 1.55 (mm).

In regard to the size of the casing 30*s*, it is assumed that the upward height from the circuit board 20*s* is 2 (mm), the length in the direction the signal line 24*s* extends is 5.4 (mm), and that the width in the direction orthogonal to the direction the signal line 24*s* extends is 3.078 (mm).

As illustrated in FIG. 7, it is assumed that the length of the long sides of the rectangular conductor patch 25*s*-1 is $X_r$, and that the length of the short sides is $Y_r$. Moreover, it is assumed that the total sum of the length of the long side $X_r$ and short sides $Y_r$ (i.e., $X_r+Y_r$) is length L.

In an example of the electromagnetic field simulation below, as illustrated in FIG. 8, a simulation analysis is performed upon fixing the length of the long sides $X_r$ to 1850 (μm), and by varying the value of the length of the short sides $Y_r$ and length L as depicted in FIG. 7. An example of the simulation result is depicted in FIG. 9 and FIG. 10.

Figure 9:
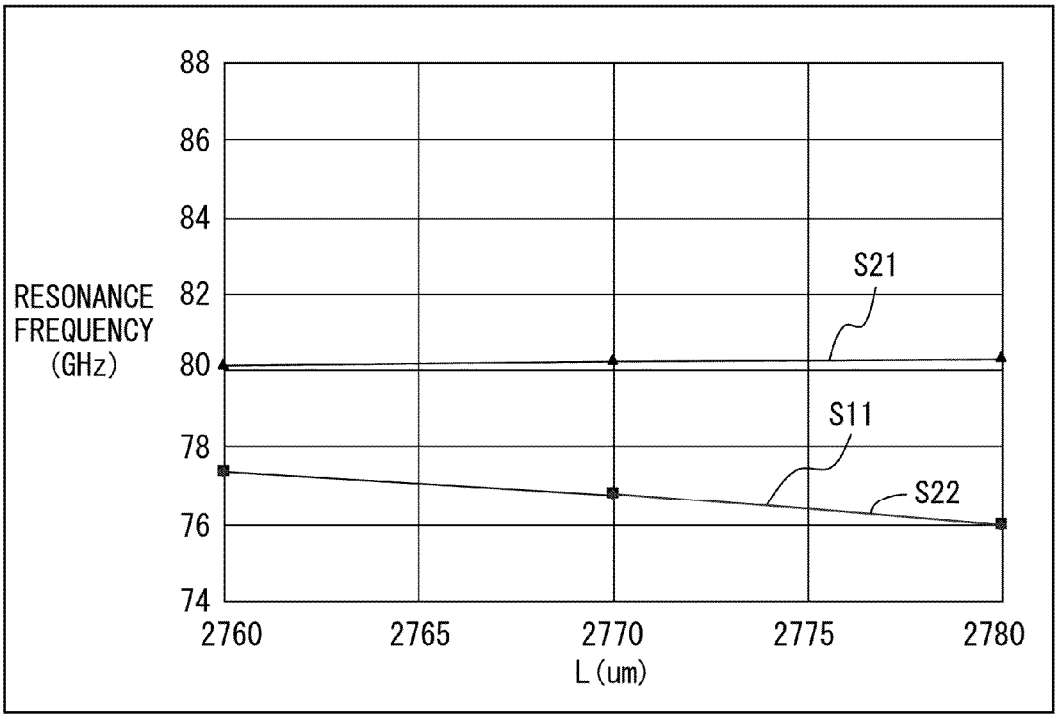
FIG. 9 depicts the relationship between the length L of the rectangular patch and a resonance frequency of the pass characteristic or a resonance frequency of the reflection characteristic.

FIG. 9 depicts the relationship between the length L of the rectangular patch and a resonance frequency of the pass characteristic or a resonance frequency of the reflection characteristic. FIG. 10 depicts the relationship between the length L of the rectangular patch and the band of reflection characteristic where the loss becomes −10 (dB).

Firstly, referring to FIG. 9, when the length $X_r$ of the long sides of the rectangular conductor patch 25*s*-1 is fixed to 1850 (μm) and the length of the short sides $Y_r$ is varied, the resonance frequency that degrades the pass characteristic indicated by the scattering parameter S21 is nearly constant regardless of the value of the length L. On the other hand, the resonance frequency of the reflection characteristic indicated by the scattering parameters S11 and S22 changes to a low frequency due to the increase in the value of the length L, i.e., due to the increase in the value of the length of the short sides $Y_r$. As a result, it is understood that when the value of the length of the long sides $X_r$ of the rectangular conductor patch 25*s*-1 is fixed and the value of the length of the short sides $Y_r$ increases, the distance increases between the resonance frequency of the reflection characteristic, i.e., the center frequency of an active frequency band, and the resonance frequency of a pass characteristic. Moreover, it is understood that the smaller the difference between the length of the short sides $Y_r$ and the length of the long sides $X_r$ becomes, the larger the difference between the center frequency of an active frequency band and the resonance frequency of a pass characteristic becomes.

Figure 10:
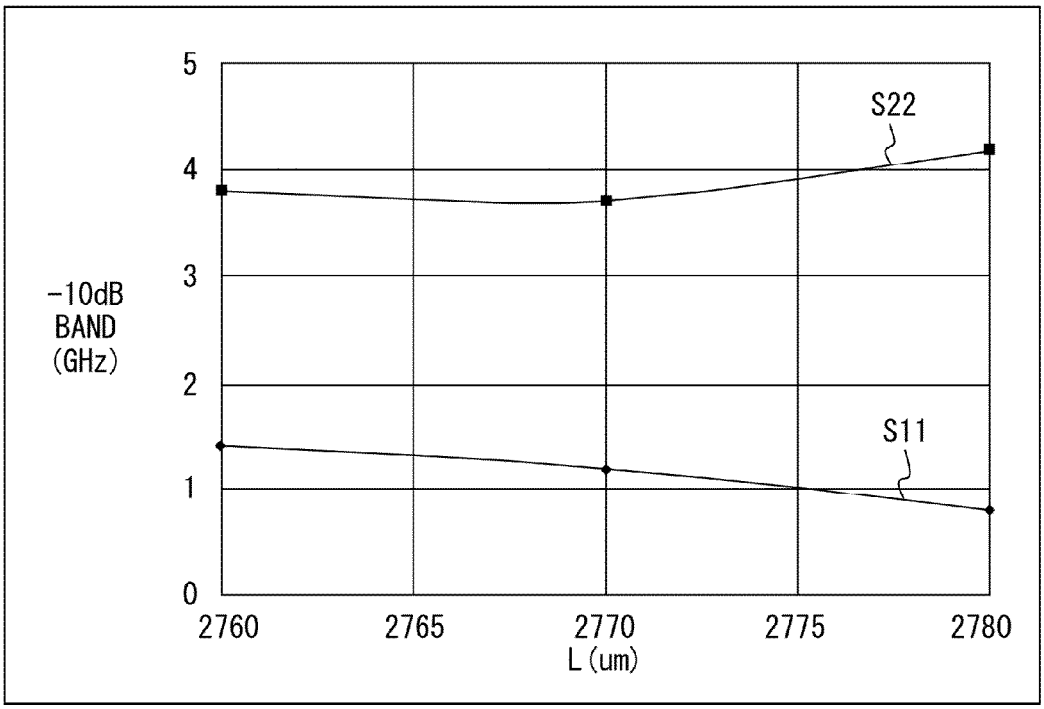
FIG. 10 depicts the relationship between the length L of the rectangular patch and the band of reflection characteristic where the loss becomes −10 (dB)

Next, referring to FIG. 10, when the length $X_r$ of the long sides of the rectangular conductor patch 25*s*-1 is fixed to 1850 (μm) and the length of the short sides $Y_r$ is varied, the band where the loss of the reflection characteristic indicated by S11 becomes −10 (dB) decreases as the value of the length L increases, i.e., as the value of the length of the short sides $Y_r$ increases. On the other hand, the band where the loss of the reflection characteristic indicated by S22 becomes −10 (dB) decreases and later increases as the value of the length L increases, i.e., as the value of the length of the short sides $Y_r$ increases.

For example, it is assumed that a desirable value of the center frequency of an active frequency band, i.e., a desirable value of the resonance frequencies of the reflection characteristic S11 and S22, is 76.8 (GHz). In the simulation result depicted in FIG. 9 and FIG. 10, the length L at which the resonance frequencies of the reflection characteristic S11 and S22 become 76.8 (GHz) is 2770 (μm).

As illustrated in FIG. 8, the length of the short sides $Y_r$ of the rectangular conductor patch 25*r* when the length L is 2770 (μm) is 920 (μm). Moreover, when the straight line $L_1$ that determines the undesired resonance frequency and the straight line $L_2$ that determines the center frequency of an active frequency band as described above with reference to FIG. 4 are calculated, the straight line $L_1$ and straight line $L_2$ have the same length, which is 1305 (μm).

Note that in the simulation example described above with reference to FIGS. 8 to 10, the length of the long sides of the conductor patch 25*r* is fixed and the length of the short sides is varied. However, an optimal length of the long sides at which the center frequency of an active frequency band, i.e., the resonance frequency of reflection characteristic, has a desirable value (for example, 76.8 (GHz)) may be obtained by fixing the length of the short sides of the conductor patch 25*r* and changing the length of the long sides.

Next, the shape and size of the conductor patch 25A of the waveguide converter 1 by which a desired signal conversion performance may be obtained will be described.

Figure 11:
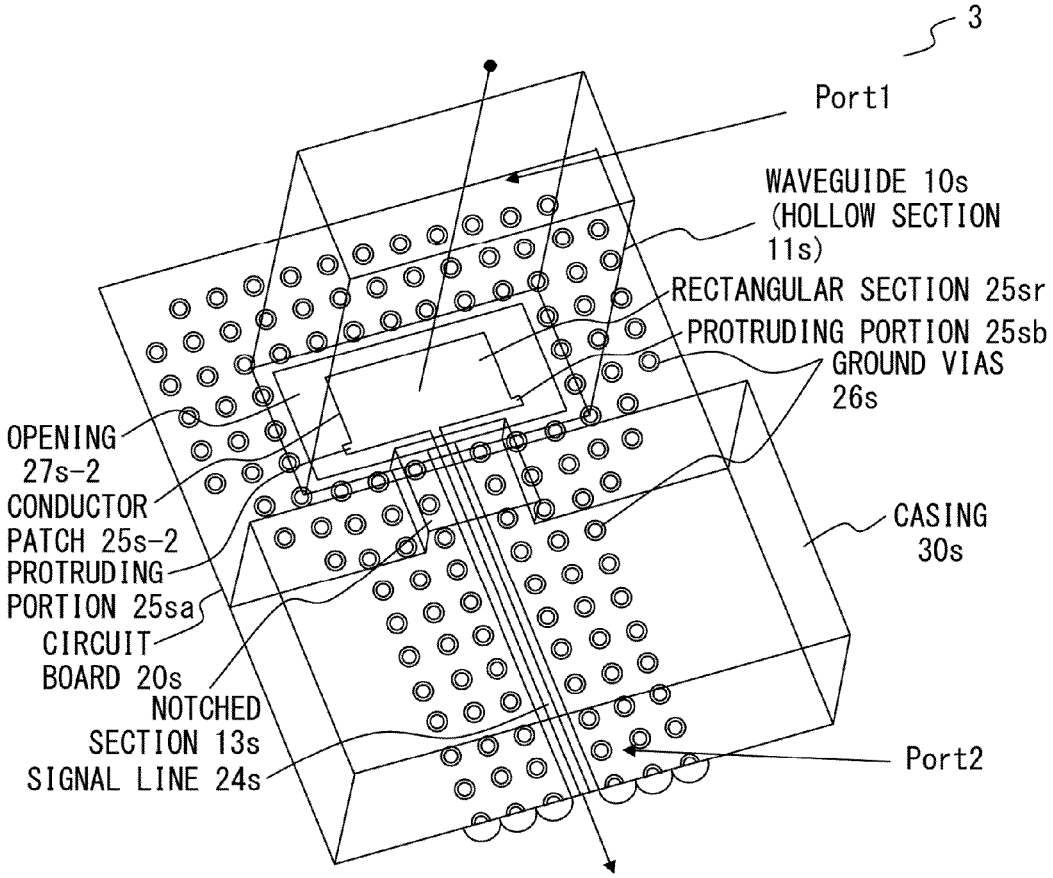
FIG. 11 is a perspective view of a simulation model of a waveguide converter that is provided with the conductor patch according to the first embodiment.
Figure 12:
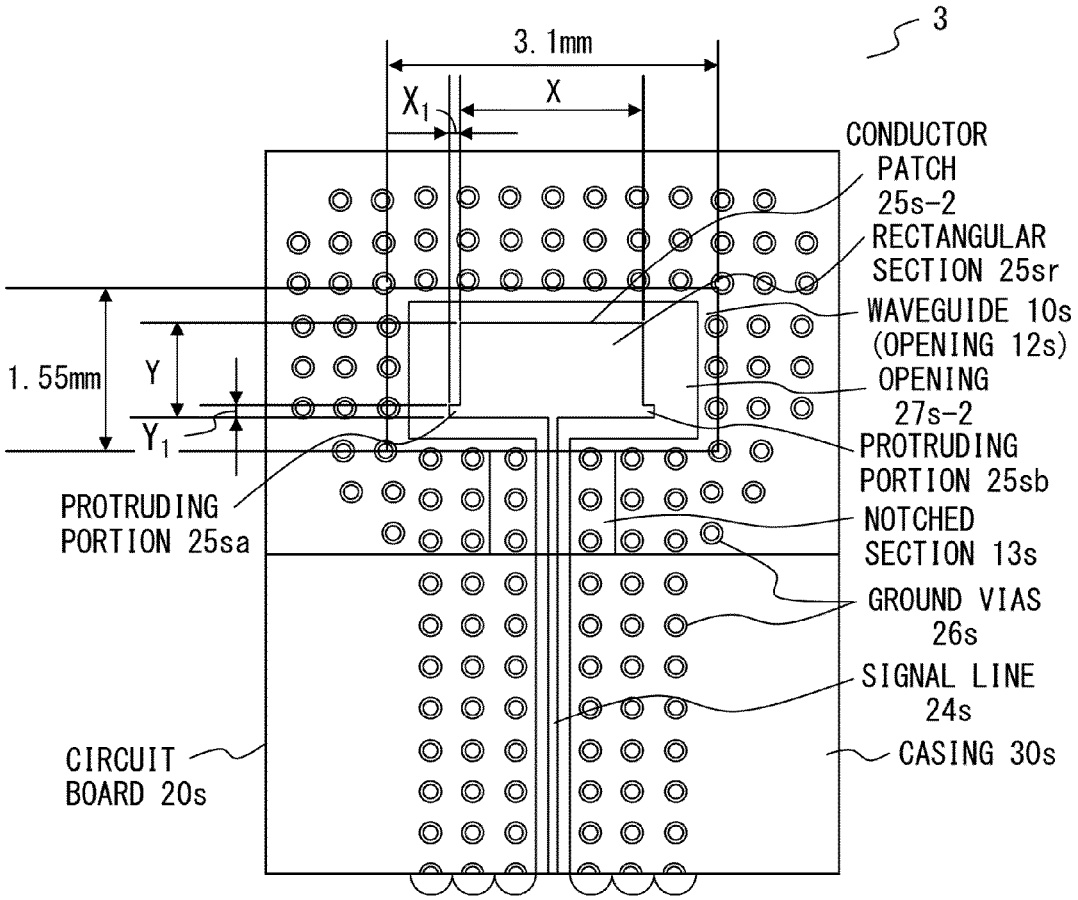
FIG. 12 is a top view of a simulation model of a waveguide converter that is provided with the conductor patch according to the first embodiment.

FIG. 11 is a perspective view of a simulation model of a waveguide converter that is provided with the conductor patch according to the first embodiment. FIG. 12 is a top view of a simulation model of a waveguide converter that is provided with the conductor patch according to the first embodiment.

The same reference signs as those assigned to elements of the simulation model 2 of the waveguide converter illustrated in FIG. 6 and FIG. 7 are assigned to the corresponding elements of the simulation model 3 of the waveguide converter illustrated in FIG. 11 and FIG. 12.

A waveguide 10*s* illustrated in FIG. 11 and FIG. 12 corresponds to the waveguide 10. In the simulation model 3 of the waveguide converter illustrated in FIG. 11 and FIG. 12, a hollow section 11*s* and an opening 12*s* are set as a model of the waveguide 10*s*.

A circuit board 20*s* corresponds to the circuit board 20. A signal line 24*s* corresponds to the signal line 24. Ground vias 26*s* correspond to the ground vias 26.

A conductor patch 25*s*-2 corresponds to the conductor patch 25A according to the first embodiment, as illustrated in FIG. 5.

As illustrated in FIG. 12, the conductor patch 25*s*-2 includes a rectangular section 25*sr* and protruding portions 25*sa* and 25*sb*. The rectangular section 25*sr* corresponds to the rectangular section 25Ar, and is a rectangular-shaped portion of the conductor patch 25*s*-2. The protruding portions 25*sa* and 25*sb* correspond to the protruding portions 25Aa and 25Ab, respectively, and are protruding portions of the conductor patch 25*s*-2.

The rectangular section 25*sr* has short sides in the direction parallel with the transmission direction of a signal on the signal line 24*s*, and has long sides in the direction orthogonal to the transmission direction of that signal. In other words, the rectangular section 25*sr* has short sides in the same direction as that of the short sides of the opening 12*s*, and has long sides in the same direction as that of the long sides of the opening 12*s*.

Moreover, the protruding portions 25*sa* and 25*sb* are provided on the short sides of the rectangular section 25*sr* near both ends of the long side of the rectangular section 25Ar, which is connected to the signal line 24*s*. In the simulation model 3 of the waveguide converter illustrated in FIG. 11 and FIG. 12, it is assumed that the protruding portions 25*sa* and 25*sb* are rectangular-shaped in a similar manner to the protruding portions 25Aa and 25Ab. As described above, the shape of the protruding portions 25Aa and 25Ab according to the first embodiment may be polygonal or circular instead of being rectangular.

In a similar manner to the simulation model 2 of the waveguide converter illustrated in FIG. 6 and FIG. 7, the simulation model 3 of the waveguide converter illustrated in FIG. 11 and FIG. 12 is provided with the casing 30*s* that covers the signal line 24*s* that extends outside the waveguide 10*s* from the notched section 13*s*, and that is disposed on the circuit board 20*s*. The casing 30*s* is an element that is expediently provided for the simulation model 3 of the waveguide converter in order to analyze the behavior of an electromagnetic field by using an electromagnetic field simulation. For this reason, as illustrated in FIG. 2 and FIG. 3, the casing 30*s* does not exist in the waveguide converter 1 according to the embodiment.

As illustrated in FIG. 11, a port 1 to which a signal is incident and reflected is on the waveguide 10*s* side, and a port 2 to which a signal is incident and reflected is on the signal line 24*s* side.

Except the size of the conductor patch 25*s*-2, set values are assigned to the simulation model 3 of the waveguide converter in a similar manner to the aforementioned simulation model 2 of the waveguide converter.

As illustrated in FIG. 12, the conductor patch 25*s*-2 is arranged within the opening 27*s*-2 of the circuit board 20*s*.

As illustrated in FIG. 12, it is assumed that the length of the long sides of the rectangular section 25*sr* is X, and that the length of the short sides is Y. In regard to the length of the sides of the protruding portions 25*sa* and 25*sb*, it is assumed that the length of the sides parallel with the long sides of the rectangular section 25*sr* is $X_1$, and that the length of the sides parallel with the short sides of the rectangular section 25*sr* is Y. Further, it is assumed that the length of the side of the conductor patch 25*s*-2 that is connected to the signal line 24*s* is X'. In other words, the length X' is the sum of the length X of the long sides of the rectangular section 25*sr* and the length $X_1$ of the sides of the respective protruding portions 25*sa* and 25*sb* (i.e., $X+2X_1$).

An example of the analysis result of simulation performed by varying the size of the conductor patch 25*s*-2 according to the first embodiment will be described.

Figure 13:
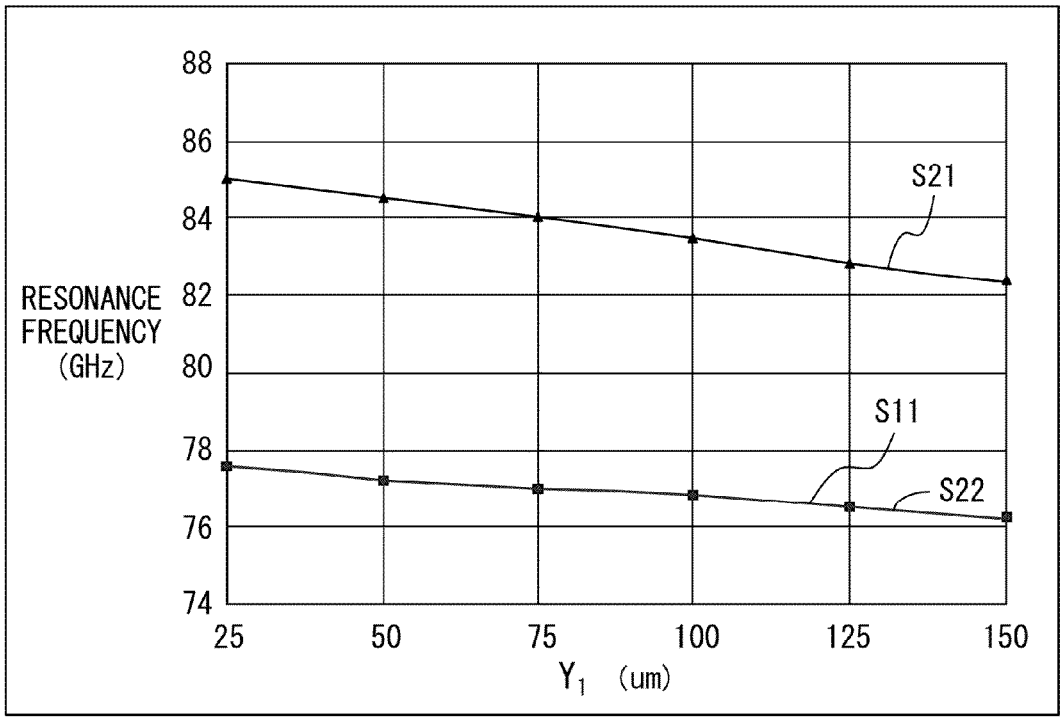
FIG. 13 depicts the relationship between $Y_1$ and a resonance frequency of the pass characteristic or a resonance frequency of the reflection characteristic when Y, X, and $X_1$ of the conductor patch according to the first embodiment are fixed and $Y_1$ is varied.
Figure 14:
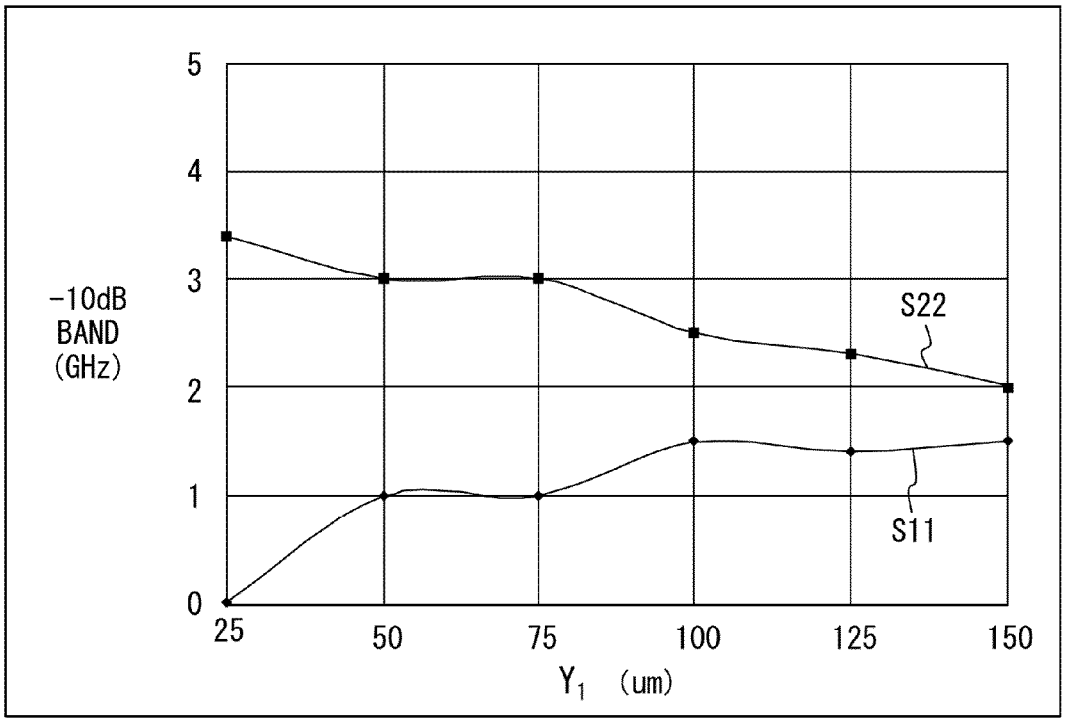
FIG. 14 depicts the relationship between $Y_1$ and the band of reflection characteristic where the loss becomes −10 (dB) when Y, X, and $X_1$ of the conductor patch according to the first embodiment are fixed and $Y_1$ is varied.

FIG. 13 depicts the relationship between $Y_1$ and a resonance frequency of the pass characteristic or a resonance frequency of the reflection characteristic when Y, X, and $X_1$ of the conductor patch according to the first embodiment are fixed and $Y_1$ is varied. FIG. 14 depicts the relationship between $Y_1$ and the band of reflection characteristic where the loss becomes −10 (dB) when Y, X, and $X_1$ of the conductor patch according to the first embodiment are fixed and $Y_1$ is varied.

In FIG. 13 and FIG. 14, a simulation result is depicted in cases where the values of Y, X, and $X_1$ are fixed to 895 (μm), 1725 (μm), and 100 (μm), respectively, and the value of $Y_1$ is varied from 25 (μm) to 150 (μm).

Referring to FIG. 13, when Y, X, and $X_1$ of the conductor patch 25*s*-2 according to the first embodiment are fixed and $Y_1$ is varied, a resonance frequency that degrades the pass characteristic indicated by the scattering parameter S21 decreases as the value of $Y_1$ increases. Moreover, a resonance frequency of the reflection characteristic indicated by the scattering parameters S11 and S22 decreases as the value of $Y_1$ increases. In view of the above, it is understood that when Y, X, and $X_1$ of the conductor patch 25*s*-2 according to the first embodiment are fixed and $Y_1$ is varied, it is difficult to keep a resonance frequency that degrades the pass characteristic away from a resonance frequency of the reflection characteristic, i.e., the center frequency of an active frequency band, even if the value of $Y_1$ is increased.

Referring to FIG. 14, when Y, X, and $X_1$ of the conductor patch 25*s*-2 according to the first embodiment are fixed and $Y_1$ is varied, the band where the loss of the reflection characteristic indicated by the scattering parameter S11 becomes −10 (dB) increases as the value of $Y_1$ increases. On the other hand, the band where the loss of the reflection characteristic indicated by scattering parameter S22 becomes −10 (dB) decreases as the value of $Y_1$ increases. In view of the above, it is understood that when Y, X, and $X_1$ of the conductor patch 25*s*-2 according to the first embodiment are fixed and $Y_1$ is varied, it is not possible to increase the band where the loss becomes −10 (dB), i.e., an active frequency band that is suitable for actual use, by increasing the value of Y.

According to such a simulation result in FIG. 13 and FIG. 14, it is understood that even if Y, X, and $X_1$ of the conductor patch 25*s*-2 according to the first embodiment are fixed and $Y_1$ is varied, it is not possible to achieve the shape and size of the conductor patch 25*s*-2 in which the signal conversion performance of the waveguide converter 1 becomes optimal.

Figure 15:
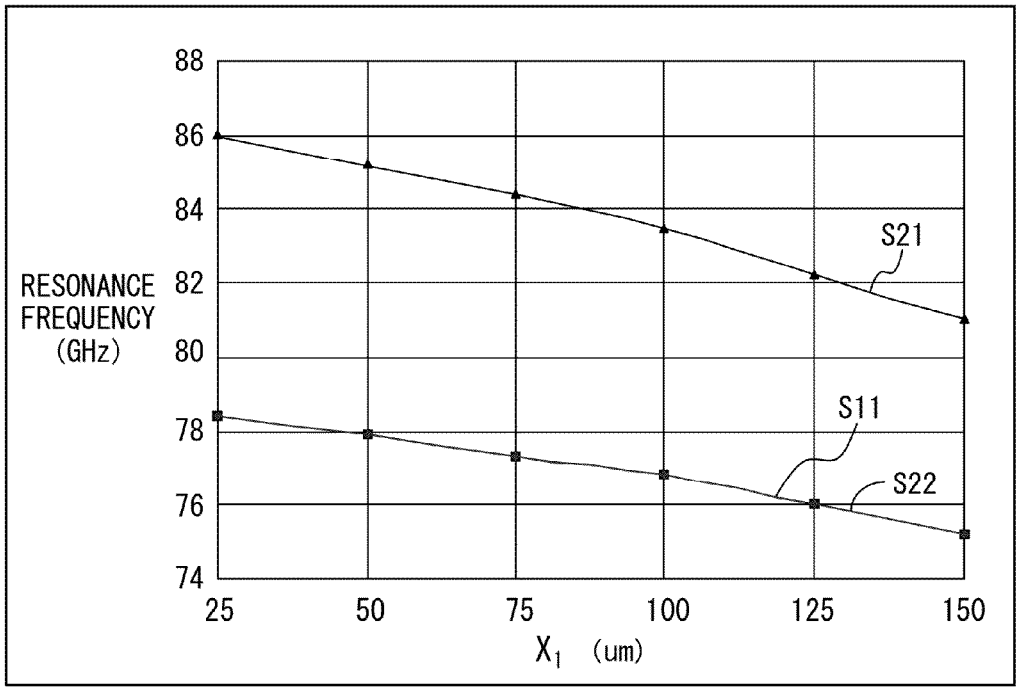
FIG. 15 depicts the relationship between $X_1$ and a resonance frequency of the pass characteristic or a resonance frequency of the reflection characteristic when Y, X, and $Y_1$ of the conductor patch according to the first embodiment are fixed and $X_1$ is varied.
Figure 16:
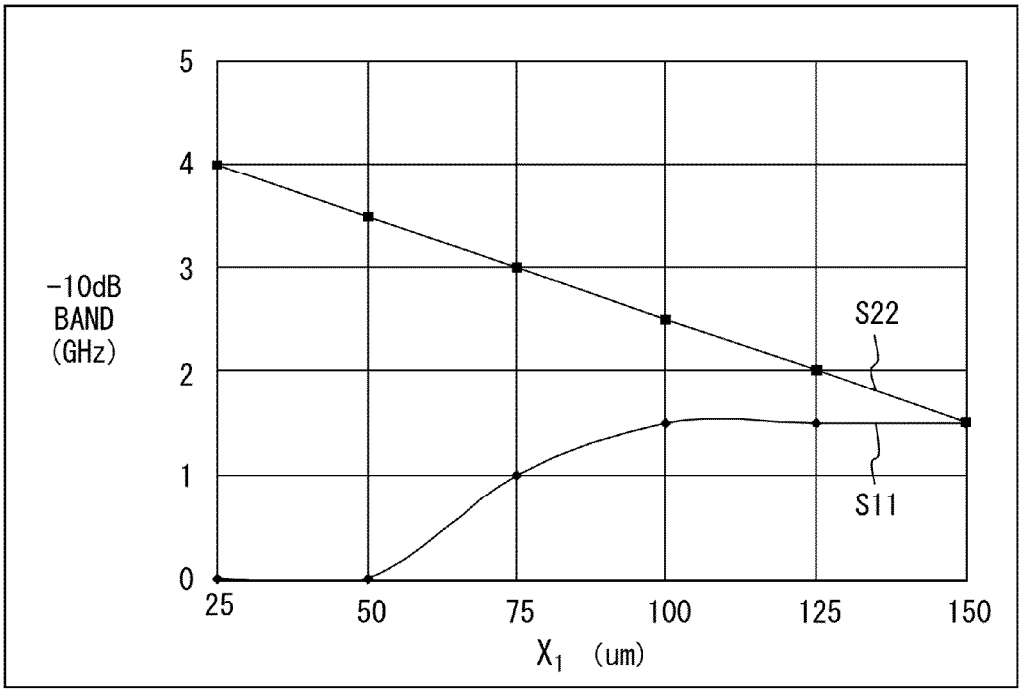
FIG. 16 depicts the relationship between $X_1$ and the band of reflection characteristic where the loss becomes −10 (dB) when Y, X, and $Y_1$ of the conductor patch according to the first embodiment are fixed and $X_1$ is varied.

FIG. 15 depicts the relationship between $X_1$ and a resonance frequency of the pass characteristic or a resonance frequency of the reflection characteristic when Y, X, and $Y_1$ of the conductor patch according to the first embodiment are fixed and $X_1$ is varied. FIG. 16 depicts the relationship between $X_1$ and the band of reflection characteristic where the loss becomes −10 (dB) when Y, X, and $Y_1$ of the conductor patch according to the first embodiment are fixed and $X_1$ is varied.

In FIG. 15 and FIG. 16, a simulation result is depicted in cases where the values of Y, X, and $Y_1$ are fixed to 895 (μm), 1725 (μm), and 100 (μm), respectively, and the value of $X_1$ is varied from 25 (μm) to 150 (μm).

Referring to FIG. 15, when Y, X, and $Y_1$ of the conductor patch 25*s*-2 according to the first embodiment are fixed and $X_1$ is varied, a resonance frequency that degrades the pass characteristic indicated by the scattering parameter S21 decreases as the value of $X_1$ increases. Moreover, a resonance frequency of the reflection characteristic indicated by the scattering parameters S11 and S22 decreases as the value of $X_1$ increases. In view of the above, it is understood that when Y, X, and $Y_1$ of the conductor patch 25*s*-2 according to the first embodiment are fixed and $X_1$ is varied, it is difficult to keep a resonance frequency that degrades the pass characteristic away from a resonance frequency of the reflection characteristic, i.e., the center frequency of an active frequency band, even if the value of $X_1$ is increased.

Referring to FIG. 16, when Y, X, and $Y_1$ of the conductor patch 25*s*-2 according to the first embodiment are fixed and $X_1$ is varied, the band where the loss of the reflection characteristic indicated by the scattering parameter S11 becomes −10 (dB) increases when the value of $X_1$ is between 50 (μm) and 100 (μm) and remains constant afterward. On the other hand, the band where the loss of the reflection characteristic indicated by scattering parameter S22 becomes −10 (dB) decreases as the value of $X_1$ increases. In view of the above, it is understood that when Y, X, and $Y_1$ of the conductor patch 25*s*-2 according to the first embodiment are fixed and $X_1$ is varied, it is not possible to increase the band where the loss becomes −10 (dB), i.e., an active frequency band that is suitable for actual use, by increasing the value of X.

According to a simulation result such as that of FIG. 15 and FIG. 16, it is understood that even if Y, X, and $Y_1$ of the conductor patch 25*s*-2 according to the first embodiment are fixed and $X_1$ is varied, it is not possible to achieve the shape and size of the conductor patch 25*s*-2 in which the signal conversion performance of the waveguide converter 1 becomes optimal.

Furthermore, according to simulation results such as those in FIG. 15 and FIG. 16 as well as FIG. 13 and FIG. 14, the following is understood. When the length of the long sides and short sides of the rectangular section 25*sr* is fixed and only the length of either one of the long sides or short sides of the protruding portions 25*sa* and 25*sb* is varied, the relationship between the varied length of sides and a resonance frequency of the pass characteristic or a resonance frequency of the reflection characteristic indicates a similar tendency regardless of whether the length of any sides are varied. Moreover, it is understood that the relationship between the varied length of the sides and the band of reflection characteristic where the loss becomes −10 (dB) also indicates a similar tendency regardless of whether the length of any sides are varied.

Figure 17:
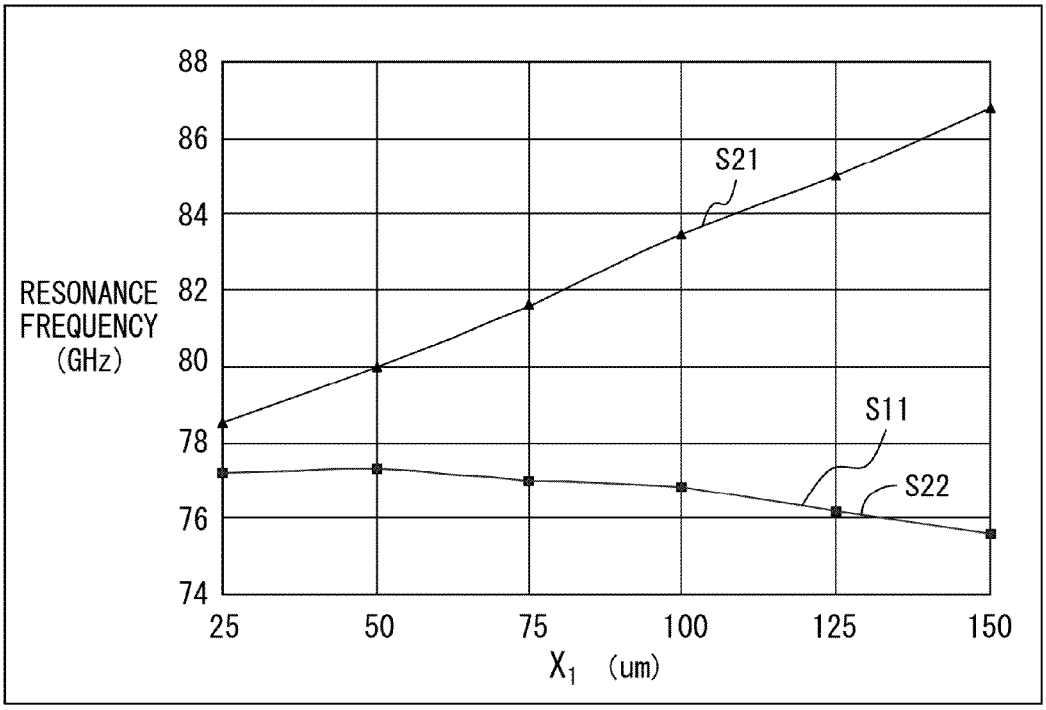
FIG. 17 depicts the relationship between $X_1$ and a resonance frequency of the pass characteristic or a resonance frequency of the reflection characteristic when Y, $Y_1$, and X' of the conductor patch according to the first embodiment are fixed and X and $X_1$ are varied.
Figure 18:
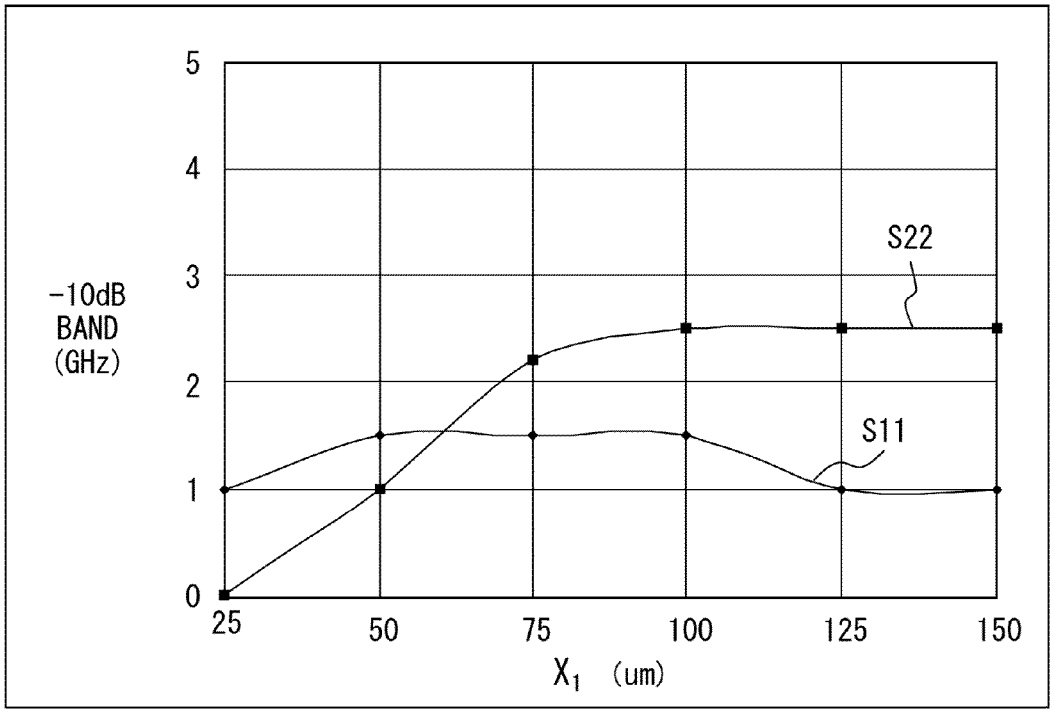
FIG. 18 depicts the relationship between $X_1$ and the band of reflection characteristic where the loss becomes −10 (dB) when Y, $Y_1$, and X' of the conductor patch according to the first embodiment are fixed and X and $X_1$ are varied.

FIG. 17 depicts the relationship between $X_1$ and a resonance frequency of the pass characteristic or a resonance frequency of the reflection characteristic when Y, $Y_1$, and X' of the conductor patch according to the first embodiment are fixed and X and $X_1$ are varied. FIG. 18 depicts the relationship between $X_1$ and the band of reflection characteristic where the loss becomes −10 (dB) when Y, $Y_1$, and X' of the conductor patch according to the first embodiment are fixed and X and $X_1$ are varied.

In FIG. 17 and FIG. 18, a simulation result is depicted in cases where the values of Y, $Y_1$, and X' are fixed to 895 (μm), 100 (μm), and 1925 (μm), respectively, and the value of $X_1$ is varied from 25 (μm) to 150 (μm). If the length X' of the side of the conductor patch 25*s*-2 that connects to the signal line 24*s* is fixed and the length $X_1$ of each side of the protruding portions 25*sa* and 25*sb* is varied, as a matter of course, the value of the length X of the long sides of the rectangular section 25*sr* is also varied.

Referring to FIG. 17, when Y, $Y_1$, and X' of the conductor patch 25*s*-2 according to the first embodiment are fixed and X and $X_1$ are varied, a resonance frequency that degrades the pass characteristic indicated by the scattering parameter S21 increases as the value of $X_1$ increases. On the other hand, a resonance frequency of the reflection characteristic indicated by the scattering parameters S11 and S22 decreases as the value of $X_1$ increases. In view of the above, it is understood that when Y, $Y_1$, and X' of the conductor patch 25*s*-2 according to the first embodiment are fixed and X and $X_1$ are varied, it is possible to keep a resonance frequency that degrades the pass characteristic away from a resonance frequency of the reflection characteristic, i.e., the center frequency of an active frequency band, if the value of $X_1$ is increased and the value of X is decreased.

Referring to FIG. 18, when Y, $Y_1$, and X' of the conductor patch 25*s*-2 according to the first embodiment are fixed and X and $X_1$ are varied, the band where the loss of the reflection characteristic indicated by S22 becomes −10 (dB) increases as the value of $X_1$ increases and remains almost constant when the value of $X_1$ becomes equal to or larger than 100 (μm). On the other hand, the band where the loss of the reflection characteristic indicated by S11 becomes −10 (dB) increases as the value of $X_1$ increases, reaches the peak until the value of $X_1$ is within a certain range (50 (μm)-100 (μm)) and decreases afterward. In view of the above, it is understood that when Y, $Y_1$, and X' of the conductor patch 25*s*-2 according to the first embodiment are fixed and X and $X_1$ are varied, the band where the loss becomes −10 (dB), i.e., a frequency band that is suitable for actual use, may be increased by increasing the value of $X_1$ into a certain range.

According to a simulation result such as that of FIG. 17 and FIG. 18, it is understood that when Y, $Y_1$, and X' of the conductor patch 25*s*-2 according to the first embodiment are fixed and X and $X_1$ are varied, it is possible to achieve the shape and size of the conductor patch 25*s*-2 in which the signal conversion performance of the waveguide converter 1 becomes optimal by increasing the value of $X_1$ into a certain range.

Hence, in view of the verification result described with reference to FIGS. 13 to 16 and the verification result described with reference to FIGS. 17 to 18, a simulation is further performed by fixing X' and increasing $X_1$, $Y_1$, X, and Y. Note that the verification result described with reference to FIGS. 13 to 16 is a verification result in which even if the value of the long sides and short sides of the rectangular section 25*sr* is fixed and only the value of either one of the long sides or the short sides of the protruding portions 25*sa* and 25*sb* is varied, it is not possible to achieve the optimal shape and size of the conductor patch 25*s*-2. Also, note that the verification result described with reference to FIGS. 17 to 18 is a verification result in which if the value of the side of the conductor patch 25*s*-2 that connects to the signal line 24*s* is fixed and the value of the sides of the protruding portions 25*sa* and 25*sb* that are parallel with the aforementioned side is adjusted, it is possible to achieve the optimal shape and size of the conductor patch 25*s*-2.

FIG. 19 is a list of the sizes of the conductor patch according to the first embodiment for which a simulation analysis is performed by fixing X' and increasing $X_1$, $Y_1$, X, and Y.

For example, it is assumed that a desired value of the center frequency of an active frequency band, i.e., the resonance frequency of the reflection characteristic, is 76.8 (GHz). In an example of the simulation below, set values $S_1$-$S_3$ are assigned in such a manner that a resonance frequency of the reflection characteristic becomes 76.8 (GHz) as illustrated in FIG. 19. In other words, the value of X'(i.e., $X+2X_1$) is fixed to 1925 (μm), and the values of the lengths $X_1$ and $Y_1$ of both sides of the protruding portions 25*sa* and 25*sb* are the same. Then, $X_1$, $Y_1$, X, Y, and L' are varied like the set values $S_1$-$S_3$ of the simulation. Note that the length L' of FIG. 19 indicates the sum of Y and X' (i.e., $Y+X+2X_1$).

In regard to set values $S_1$-$S_3$, the straight line L1' that determines an undesired resonance frequency, which is described above with reference to FIG. 5, is longer than the straight line L2' that determines the center frequency of an active frequency band. For example, in the set value $S_2$, the straight line $L_{1'}$ is 1250 (μm), and straight line $L_{2'}$ is 1243 (μm).

As described above, in the simulation model 2 of the waveguide converter provided with the conductor patch **25*s*-1, the length of the short sides $Y_r$ of the conductor patch 25*s*-1 where the center frequency of an active frequency band becomes 76.8 (GHz) when the length $X_r$ of the long sides is fixed to 1850 (μm) is 920 (μm). If the size of the conductor patch 25*s*-1 is compared with the size of the conductor patch 25*s*-2 with the set values $S_1$-$S_3$, the length Y of the short sides of the rectangular section 25*sr* that constitutes the conductor patch 25*s*-2 is shorter than the length of the short sides $Y_r$ of the conductor patch 25*s*-1 with any of the set values $S_1$-$S_3$. Moreover, the length X of the long sides of the rectangular section 25*sr* is also shorter than the length $X_r$ of the long sides of the conductor patch 25*s*-1** with any of the set values $S_1$-$S_3$.

Figure 20:
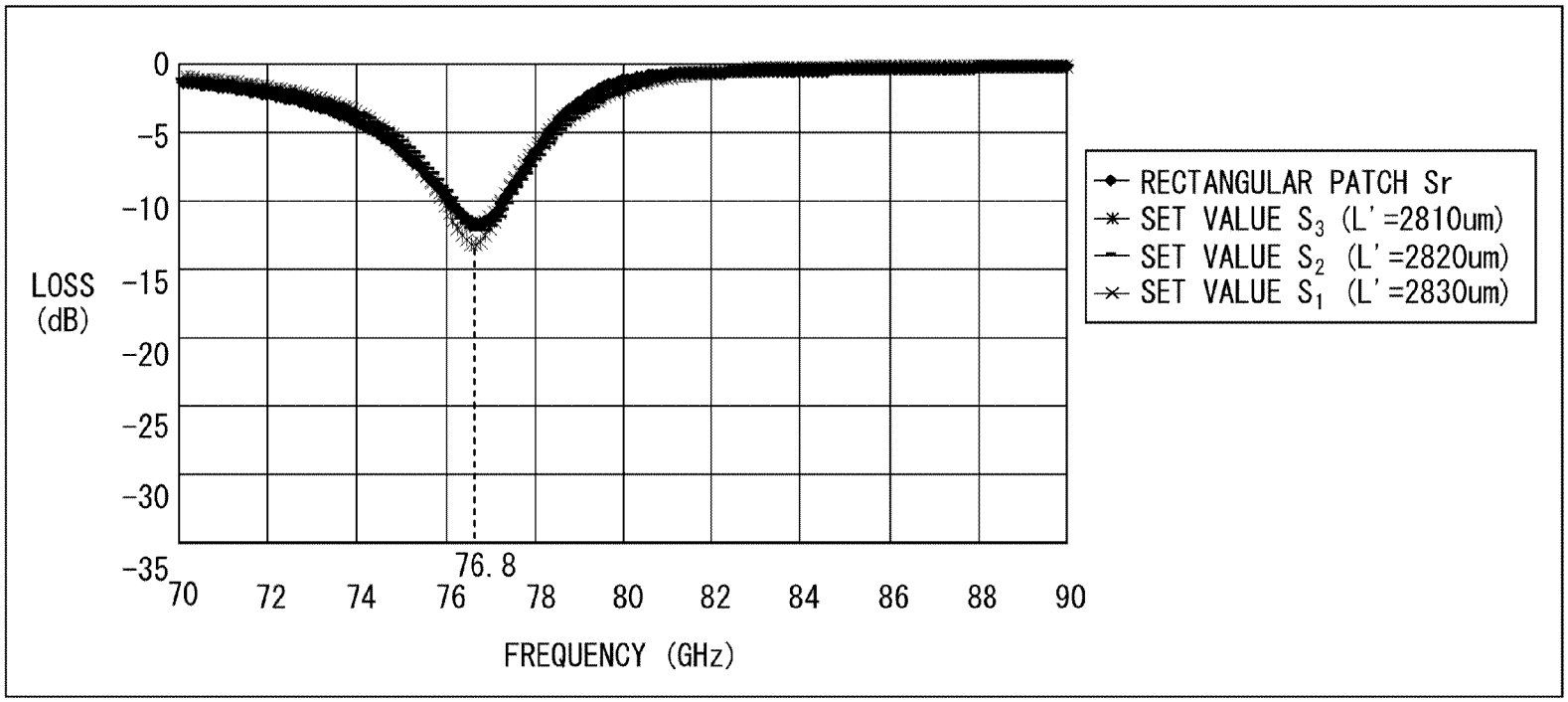
FIG. 20 depicts a reflection characteristic S11 in cases where X' of the conductor patch according to the first embodiment is fixed and the values of $X_1$ and $Y_1$ are increased.
Figure 21:
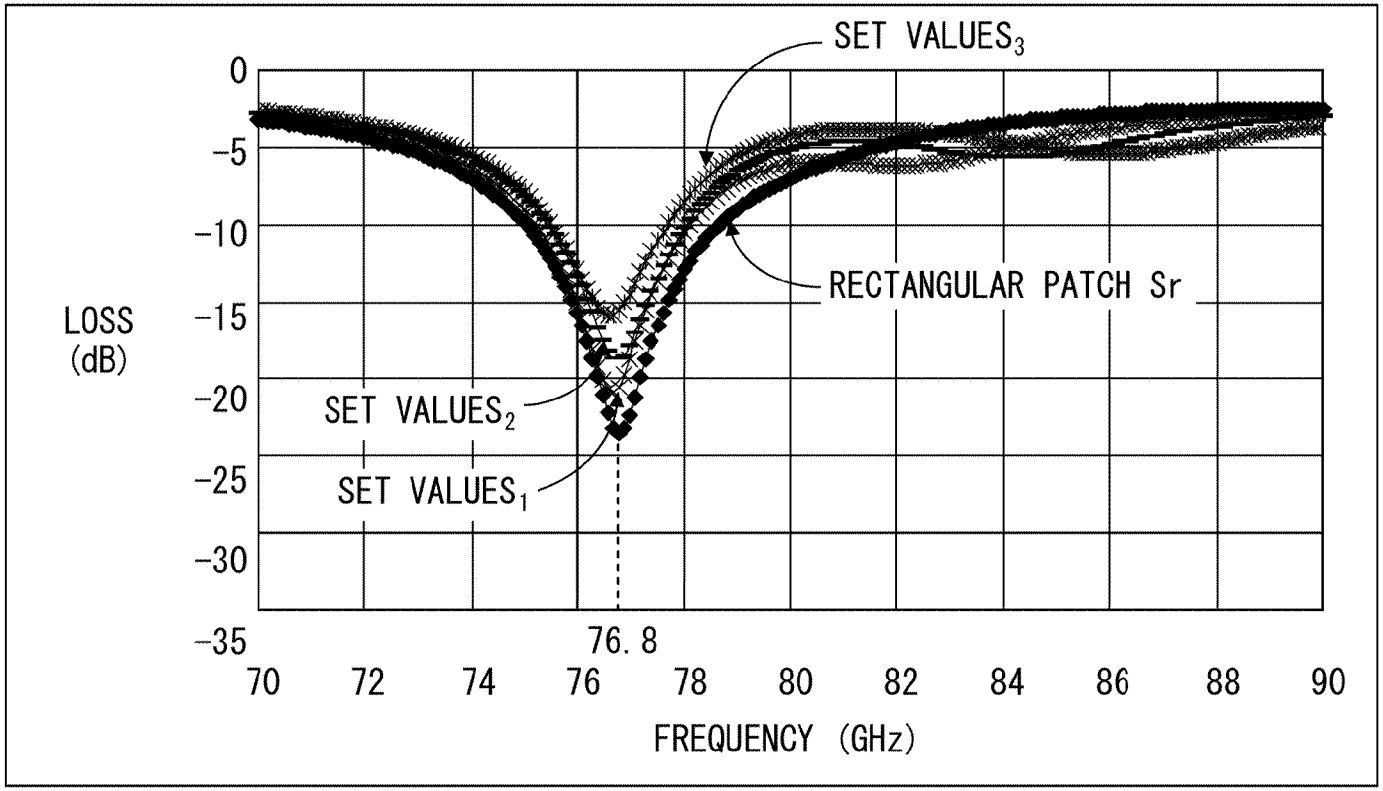
FIG. 21 depicts a reflection characteristic S22 in cases where X' of the conductor patch according to the first embodiment is fixed and the values of $X_1$ and $Y_1$ are increased.
Figure 22:
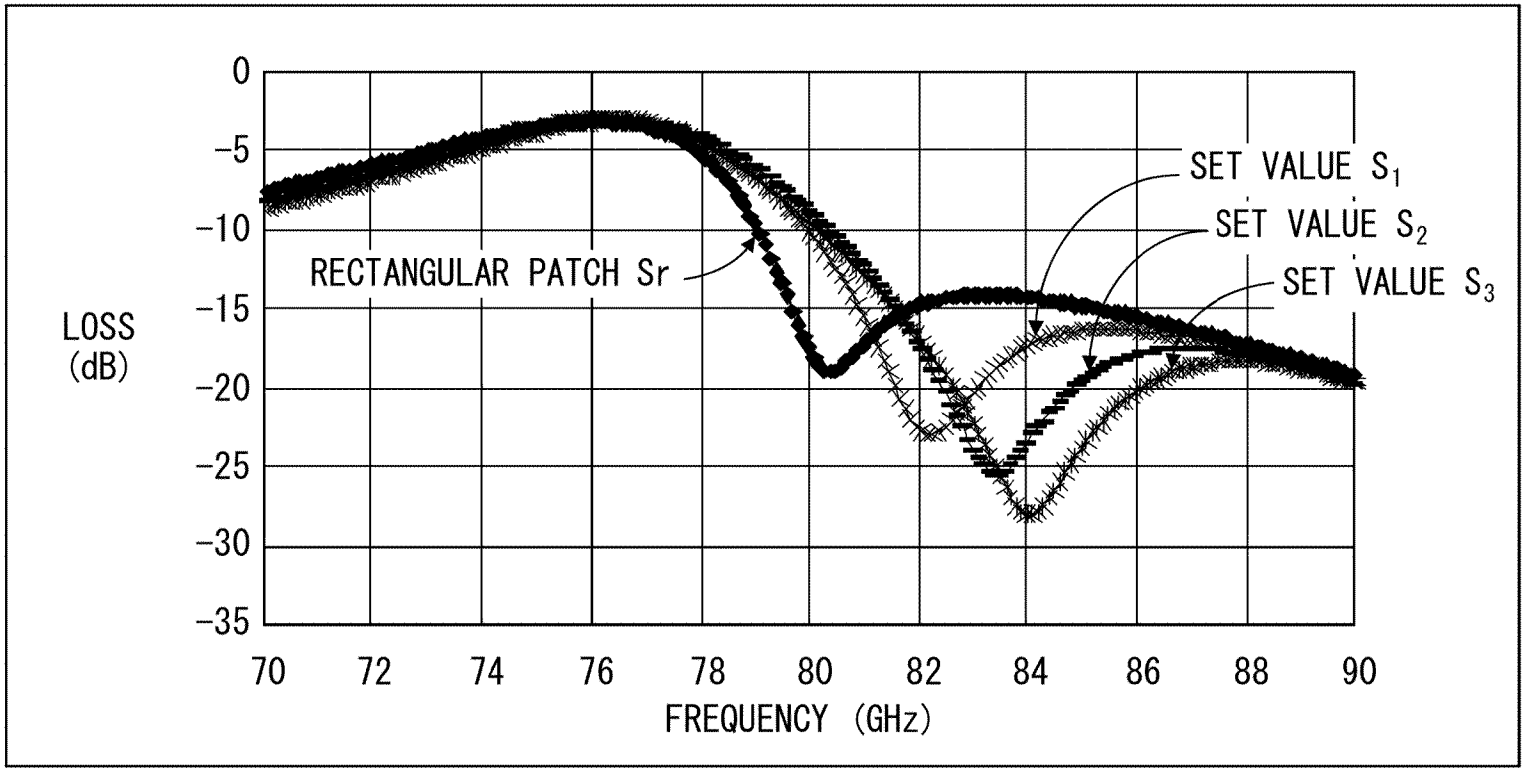
FIG. 22 depicts a pass characteristic S21 in cases where X' of the conductor patch according to the first embodiment is fixed and the values of $X_1$ and $Y_1$ are increased.

An example of the simulation result in which the shape and size of the conductor patch **25*s*-2 are varied as depicted in FIG. 19 is depicted in FIGS. 20 to 22**.

FIG. 20 depicts the reflection characteristic S11 in cases where X' of the conductor patch according to the first embodiment is fixed and the values of $X_1$ and $Y_1$ are increased. FIG. 21 depicts the reflection characteristic S22 in cases where X' of the conductor patch according to the first embodiment is fixed and the values of $X_1$ and $Y_1$ are increased. FIG. 22 depicts the pass characteristic S21 in cases where X' of the conductor patch according to the first embodiment is fixed and the values of $X_1$ and $Y_1$ are increased.

In FIGS. 20 to 23, a simulation result $S_r$ of the rectangular-shaped conductor patch **25*s*-1 is also depicted in order to compare with a simulation result of the conductor patch 25*s*-2. The simulation result $S_r$ of the conductor patch 25*s*-1 is a simulation result of the case in which the conductor patch 25*s*-1 is set to a size where a resonance frequency of the reflection characteristic indicated by the scattering parameters S11 and S22 becomes 76.8 (GHz). In particular, as described above with reference to FIG. 9 and FIG. 10, the size of the conductor patch 25*s*-1** is determined in such a manner that the length $X_r$ of the long sides becomes 1850 (μm), the length $Y_r$ of the short sides becomes 920 (μm) and that the length L that is the sum of $X_r$ and $Y_r$ becomes 2770 (μm).

Referring to FIG. 20, resonance frequencies of the reflection characteristic S11 with set values $S_1$-$S_3$ indicate 76.8 (GHz) in a similar manner to the simulation result $S_r$ of the conductor patch **25*s*-1. Referring to FIG. 21, resonance frequencies of the reflection characteristic S22 with set values $S_1$-$S_3$ also indicate 76.8 (GHz) in a similar manner to the simulation result $S_r$ of the conductor patch 25*s*-1**.

Referring to FIG. 22, simulation results with set values $S_1$-$S_3$ have a wider band where the loss of the pass characteristic S21 becomes −8 (dB) than the simulation result $S_r$. Moreover, in regard to a resonance frequency of the pass characteristic S21, simulation results with set values $S_1$-$S_3$ are further distant from resonance frequencies of the reflection characteristic S11 and S22 (76.8 (GHz)) than the simulation result $S_r$ of the conductor patch **25*s*-1**.

Accordingly, it is understood that an active frequency band that withstands actual use may become broader when the waveguide converter 1 provided with the conductor patch 25A according to the first embodiment is used than when the waveguide converter that includes the rectangular conductor patch **25*r* is used. Moreover, it is understood that a resonance frequency that degrades the pass characteristic may be further kept away from the center frequency of an active frequency band when the waveguide converter 1 provided with the conductor patch 25A according to the first embodiment is used than when the waveguide converter that includes the rectangular conductor patch 25*r*** is used.

Further referring to FIG. 22, a frequency band where the loss of the pass characteristic S21 becomes −8 (dB) is the narrowest in the cases of set value $S_1$ and is the broadest in the case of set value $S_3$ among set values $S_1$-$S_3$.

A resonance frequency of the pass characteristic S21 is the closest to the resonance frequencies of the reflection characteristic S11 and S22 (76.8 (GHz)) in the case of set value $S_1$ and is the furthest from the resonance frequencies of the reflection characteristic S11 and S22 in the case of set value $S_3$ among set values $S_1$-$S_3$.

On the other hand, referring to FIG. 21, a frequency band of the reflection characteristic S22 where the loss becomes −10 (dB) is the narrowest in the cases of set value $S_3$ and is the broadest in the case of set value $S_1$ among set values $S_1$-$S_3$.

Thus, the size of the conductor patch **25*s*-2 in which the signal conversion performance becomes optimal among set values $S_1$-$S_3$ in view of not only the pass characteristic S21 but also the reflection characteristic S11 and S22 is determined as follows by further analyzing the reflection coefficients S11 and S22**.

Figure 23:
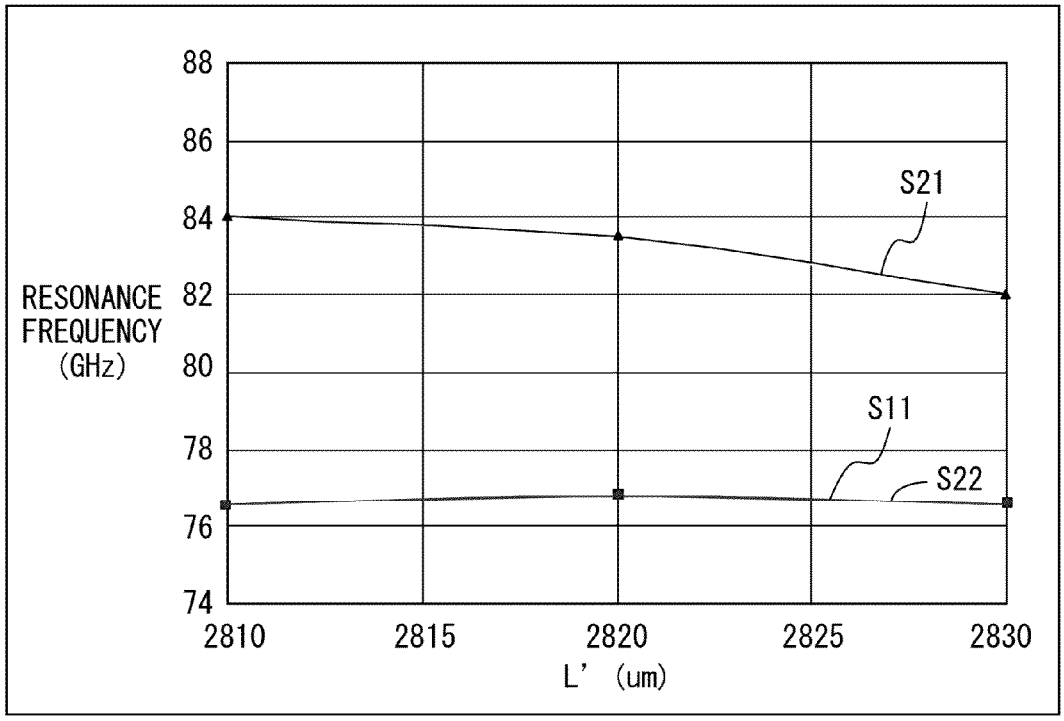
FIG. 23 depicts the relationship between L' and a resonance frequency of the pass characteristic or a resonance frequency of the reflection characteristic when X' is fixed and $X_1$, $Y_1$, X, and Y are increased.
Figure 24:
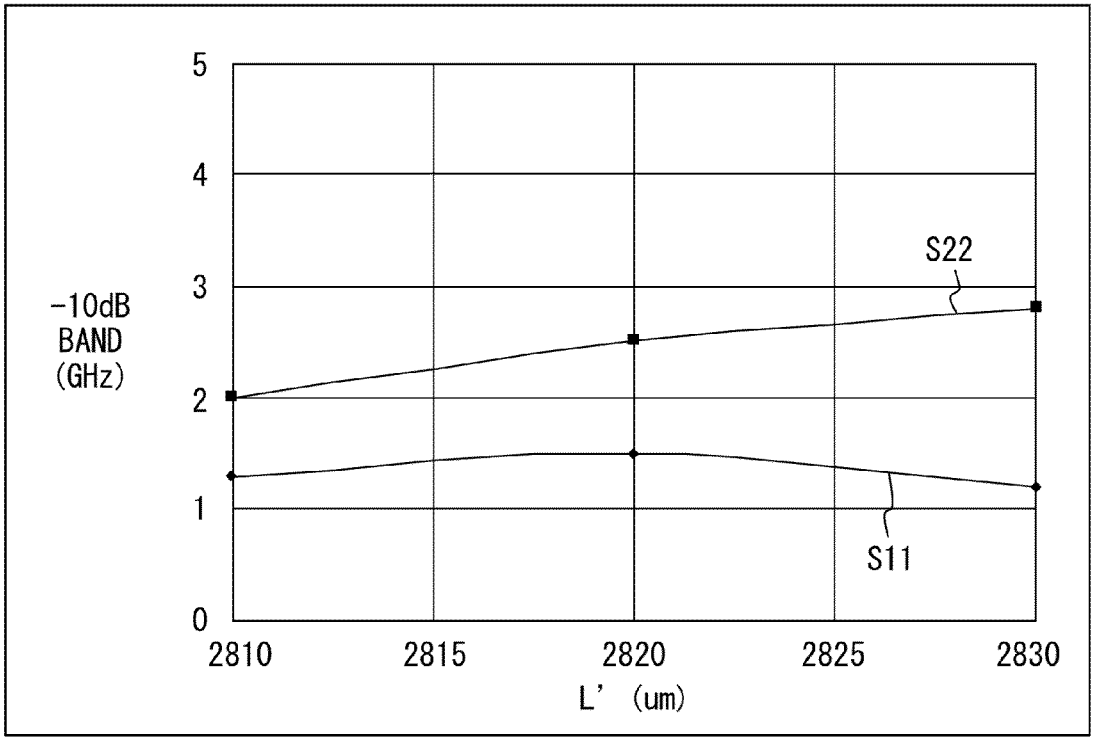
FIG. 24 depicts the relationship between L' and the frequency band of reflection characteristic where the loss becomes −10 (dB) when X' is fixed and $X_1$, $Y_1$, X, and Y are increased.

FIG. 23 depicts the relationship between L' and a resonance frequency of the pass characteristic or a resonance frequency of the reflection characteristic when X' is fixed and $X_1$, $Y_1$, X, and Y are increased. FIG. 24 depicts the relationship between L' and the frequency band of reflection characteristic where the loss becomes −10 (dB) when X' is fixed and $X_1$, $Y_1$, X, and Y are increased. As depicted in FIG. 19, the value of the length L' of the set value $S_1$ is 2810 (μm) the value of the length L' of the set value $S_2$ is 2820 (μm) and the value of the length L' of the set value $S_3$ is 2830 (μm).

Referring to FIG. 23, resonance frequencies of the reflection characteristic S11 and S22 are constant at 76.8 (GHz) regardless of the increase in the value of the length L' (i.e., Y+X'). This is consistent with the fact that the resonance frequencies of the reflection characteristic S11 and S22 with set values $S_1$-$S_3$ are both at 76.8 (GHz) in FIG. 20 and FIG. 21.

Referring to FIG. 23, a resonance frequency that impairs the pass characteristic S21 decreases as the value of the length L' increases. This is consistent with the fact that in FIG. 22, a resonance frequency of the pass characteristic S21 with the set value $S_3$ is the highest and a resonance frequency of the pass characteristic S21 with the set value $S_1$ is the lowest among the set values $S_1$-$S_3$.

Thus, the size of the conductor patch **25*s*-2 in which the signal conversion performance of the waveguide converter 1 becomes optimal in view of not only the pass characteristic S21 but also the reflection characteristic S11 and S22 will be further analyzed with reference to FIG. 24**.

In FIG. 24, the frequency band where the loss of the reflection characteristic S22 becomes −10 (dB) increases as the value of the length L' increases. This is consistent with the fact that the frequency band where the loss of the reflection characteristic S22 becomes −10 (dB) is the narrowest in the cases of set value $S_3$ and is the broadest in the case of set value $S_1$ among set values $S_1$-$S_3$ in FIG. 21.

On the other hand, in FIG. 24, as the value of the length L' increases, the frequency band where the loss of the reflection characteristic S11 becomes −10 (dB) reaches a peak when the value of the length L' is at 2820 (μm), and decreases afterward.

As a result of such simulation as depicted in FIG. 24, it is possible to determine that the optimal size of the conductor patch **25*s*-2 in which the reflection characteristic S22 and the reflection characteristic S11 are the best is the set value $S_2$ among the set values $S_1$-$S_3$ with which superior pass characteristic S21 may be obtained in comparison with the waveguide converter provided with the rectangular conductor patch 25***s*-1.

Figure 25:
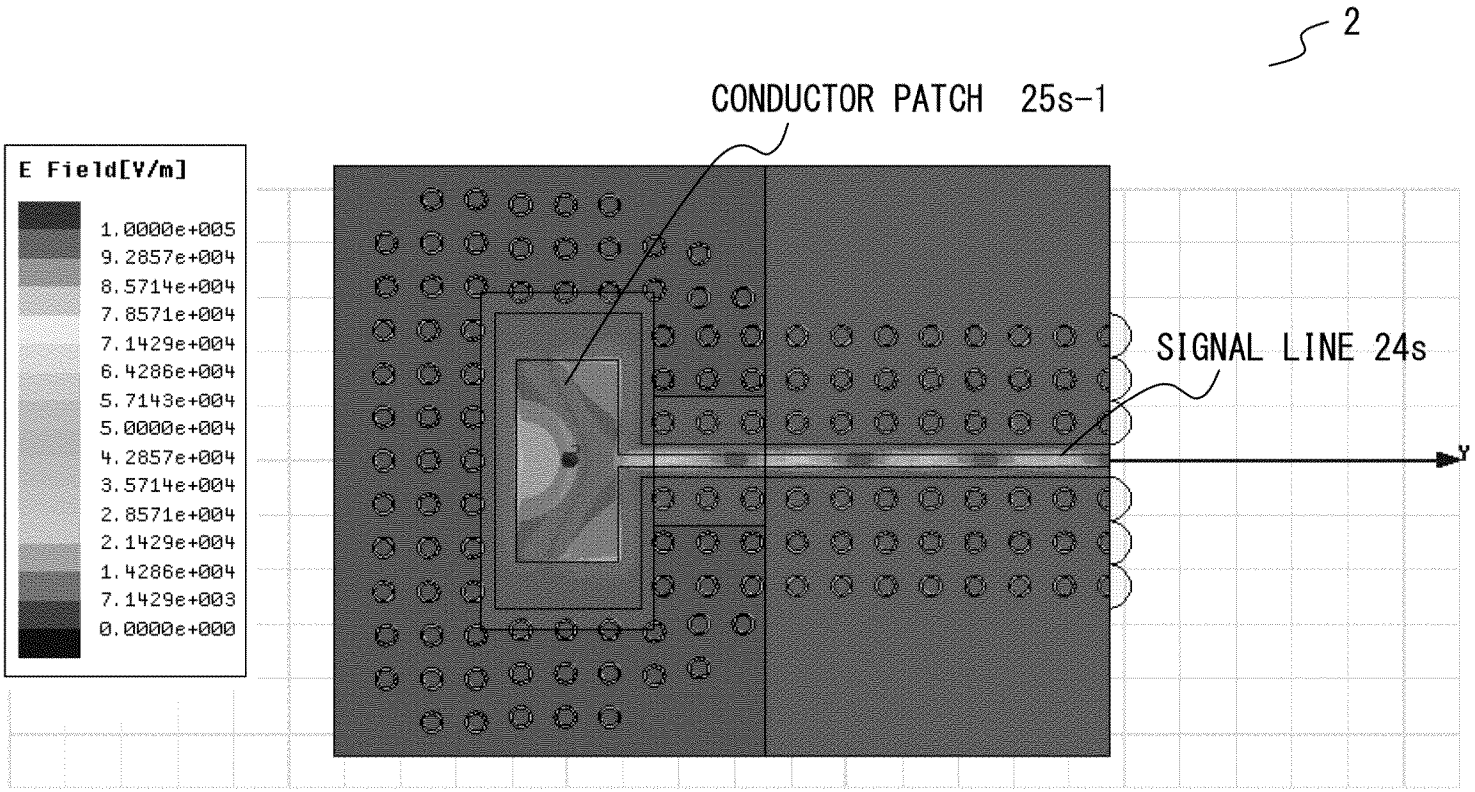
FIG. 25 depicts an electric field intensity distribution of the pass characteristic S21 in the resonance frequency of a rectangular conductor patch.
Figure 26:
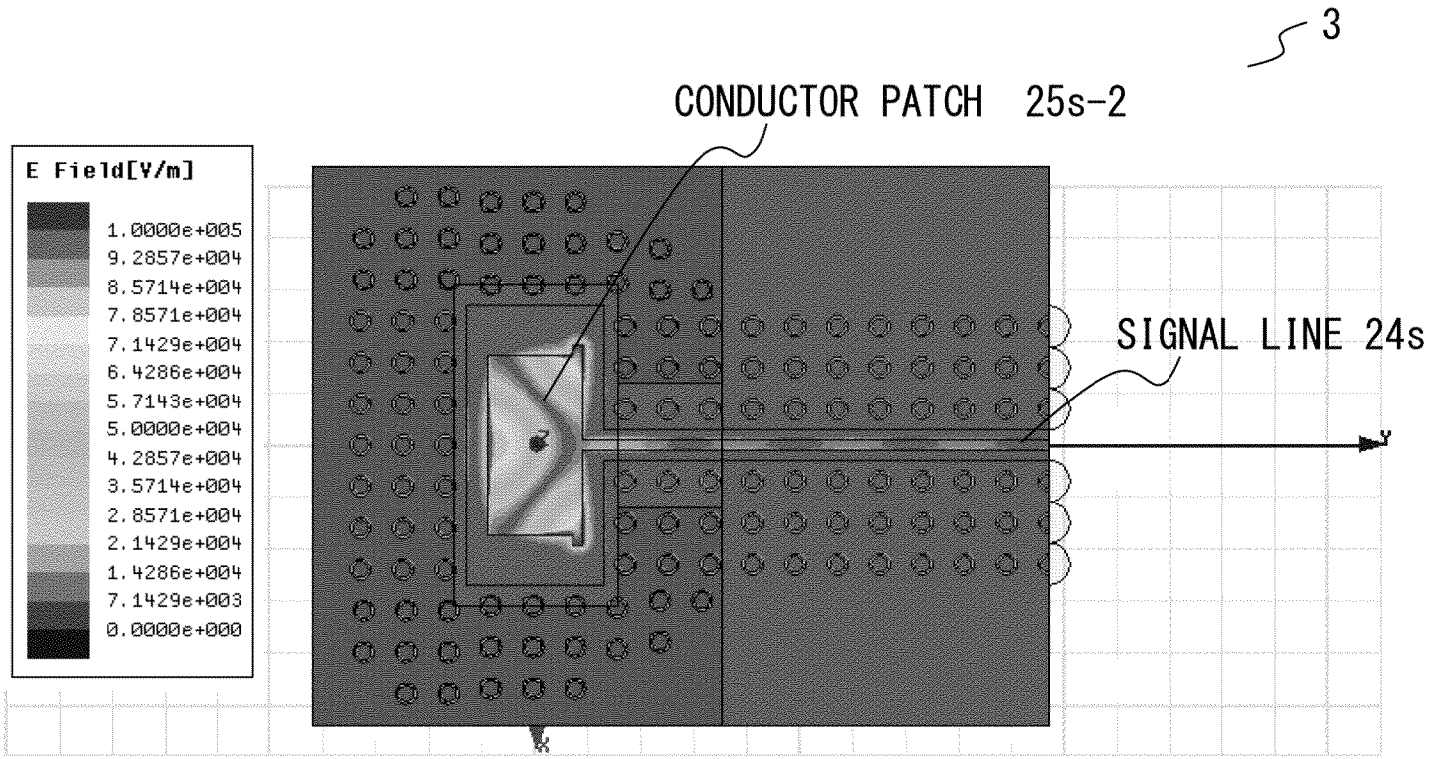
FIG. 26 depicts an electric field intensity distribution of the pass characteristic S21 in the resonance frequency of a conductor patch according to the first embodiment.

FIG. 25 depicts an electric field intensity distribution of the pass characteristic S21 in the resonance frequency of a rectangular conductor patch. FIG. 26 depicts an electric field intensity distribution of the pass characteristic S21 in the resonance frequency of a conductor patch according to the first embodiment.

The electric field intensity distribution of FIG. 25 is an electric field intensity distribution on the circuit board 20*s* in the resonance frequency 80.3 (GHz) of the pass characteristic S21 when the short side Y of the conductor patch 25*s*-1 is 920 (μm) and the long side X is 1850 (μm). As illustrated in FIG. 20 and FIG. 21, when the short side Y of the conductor patch 25*s*-1 is 920 (μm) and the long side X is 1850 (μm), resonance frequencies of the reflection characteristic S11 and S22 are 76.8 (GHz). As illustrated in FIG. 22, when the short side Y of the conductor patch 25*s*-1 is 920 (μm) and the long side X is 1850 (μm), a resonance frequency of the pass characteristic S21 is 80.3 (GHz).

On the other hand, an electric field intensity distribution illustrated in FIG. 26 is an electric field intensity distribution on the circuit board 20*s* in the resonance frequency 83.5 (GHz) of the pass characteristic S21 when the set value $S_2$ of FIG. 19 is applied to the size of the conductor patch 25*s*-2. As illustrated in FIG. 20 and FIG. 21, when the set value $S_2$ is applied to the size of the conductor patch 25*s*-2, a resonance frequencies of the reflection characteristic S11 and S22 are at 76.8 (GHz). As illustrated in FIG. 22, when the set value $S_2$ is applied to the size of the conductor patch 25*s*-2, a resonance frequency of the pass characteristic S21 is at 83.5 (GHz).

FIG. 25 and FIG. 26 are compared with each other as follows. In an electric field intensity distribution of FIG. 25, it is merely indicated that at regions near both ends of a long side of the conductor patch 25*s*-1 that is connected to the signal line 24*s*, and at a region near the center of the other long side of the conductor patch 25*s*-1, an electric field intensity does not become low. In other words, in a resonance frequency of the pass characteristic S21 of the waveguide converter provided with the conductor patch 25*s*-1, the electromagnetic field intensity on the circuit board 20*s* is extensively low.

On the other hand, in an electric field intensity distribution of FIG. 26, no electromagnetic field intensity becomes the minimum value except the electric field intensity at the region that extends from the center of a side of the conductor patch 25*s*-2 to which the signal line 24*s* is connected to both ends of the other side of the conductor patch 25*s*-2 which is parallel with the aforementioned side. In other words, in a resonance frequency of the pass characteristic S21 of the waveguide converter provided with the conductor patch 25*s*-2, the electromagnetic field intensity on the circuit board 20*s* is extensively high.

Accordingly, it is also understood from the electric field intensity distributions of FIG. 25 and FIG. 26 that the signal conversion performance of the waveguide converter 1 provided with the conductor patch 25A including the protruding portions 25Aa and 25Ab is superior to the signal conversion performance of the waveguide converter that includes the rectangular conductor patch 25*r*.

As described above, the waveguide converter 1 that is provided with the conductor patch 25A including the protruding portions 25Aa and 25Ab may broaden the active frequency band in comparison with the waveguide converter that includes the rectangular conductor patch 25*r*. In other words, it becomes possible to broaden a band in which the loss in the pass characteristic indicated by the scattering parameter S21 becomes a loss that is permissible in the actual use (for example, −8 (dB)).

Moreover, the waveguide converter 1 that is provided with the conductor patch 25A including the protruding portions 25Aa and 25Ab may keep a resonance frequency that degrades the pass characteristic away from the center frequency of an active frequency band in comparison with the waveguide converter that includes the rectangular conductor patch 25*r*.

Accordingly, the waveguide converter according to the present embodiment may broaden the active frequency band at the design stage, and may keep a resonance frequency that degrades the pass characteristic away from the center frequency of an active frequency. As a result, even if a resonance frequency that degrades the pass characteristic deviates, for example, due to the variation in dimension and alignment caused when the waveguide converter is manufactured, a deterioration in the pass characteristic may be minimized, and a required signal conversion performance may be secured. As it is possible to secure a required signal conversion performance without requiring a high accuracy in manufacturing, the required accuracy in manufacturing of a waveguide converter is not necessarily very high, and the cost reduction of a waveguide converter may be realized.

Further, according to the present embodiment, simulation analysis is performed, and thereby an appropriate shape and size of a conductor patch that has protruding portions on the short sides near both ends of the long side of a rectangular section on the signal line side may be determined in view of not only the pass characteristic S21 but also the reflection characteristic S11 and S22.

Note that as described above, the shape and size of the conductor patch according to the first embodiment is not limited to the shape and size illustrated in FIGS. 2, 3, and 5 to 26. For example, the shape of the protruding portions 25Aa and 25Ab is not necessarily rectangular, but may be polygonal or circular.

Second Embodiment

Figure 27:
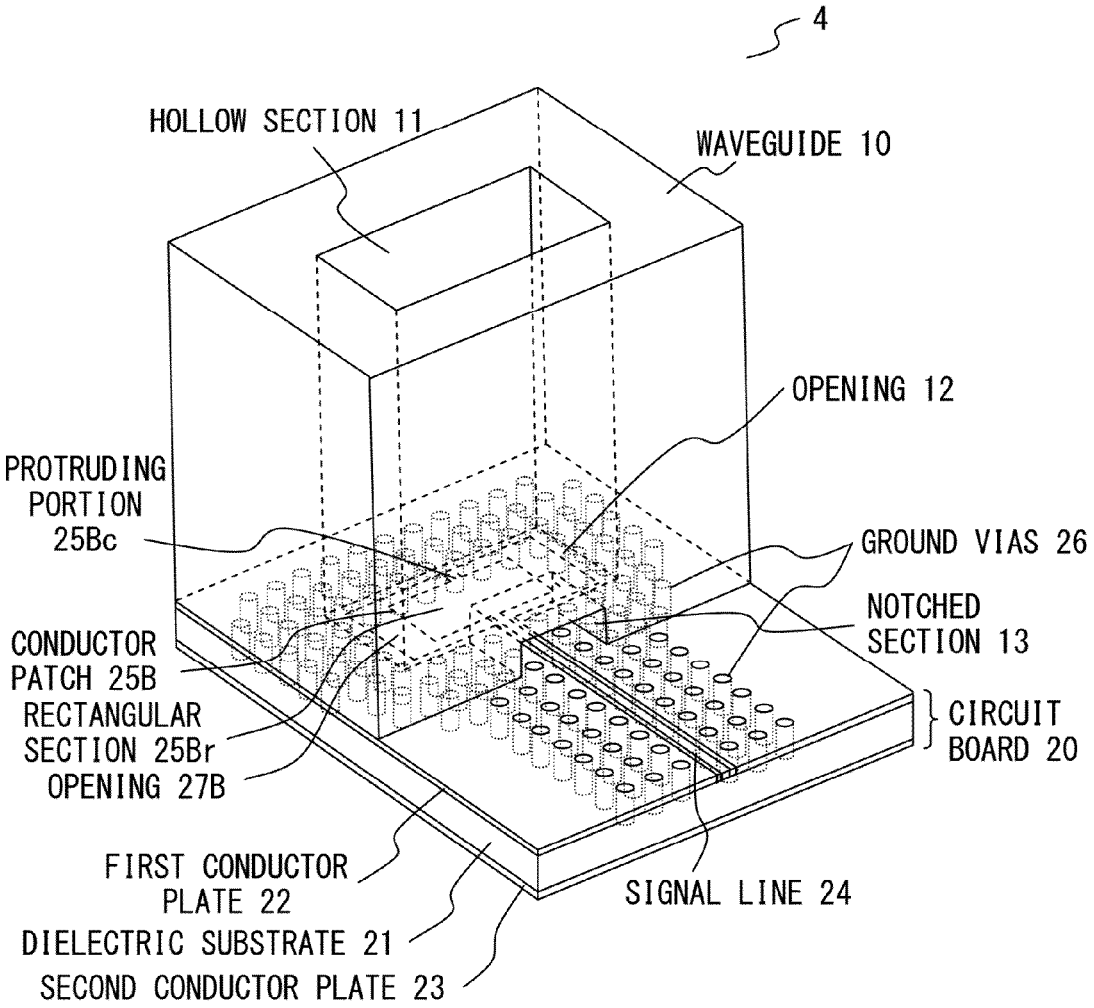
FIG. 27 is a perspective view of an example of the waveguide converter according to the second embodiment.
Figure 28:
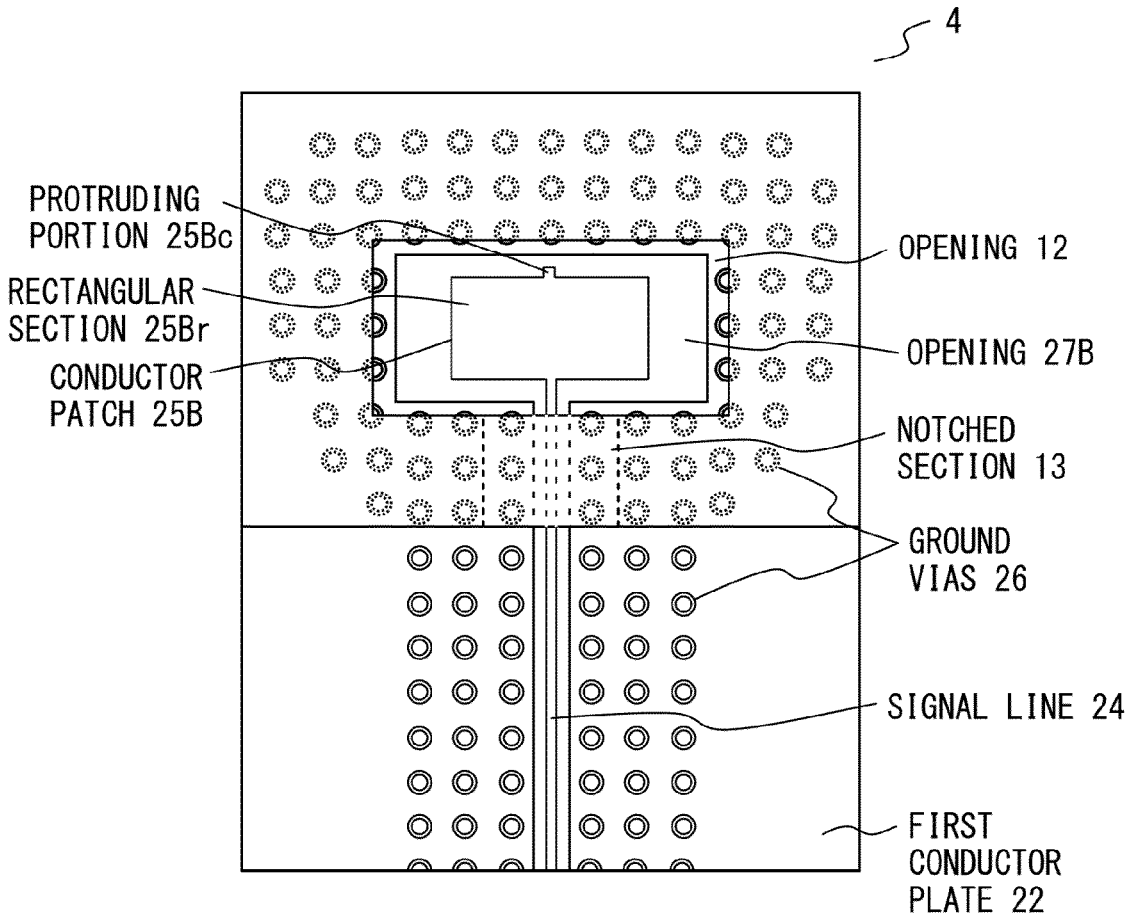
FIG. 28 is a top view of an example of the waveguide converter according to the second embodiment.

FIG. 27 is a perspective view of an example of the waveguide converter according to the second embodiment. FIG. 28 is a top view of an example of the waveguide converter according to the second embodiment.

Note that the same reference signs as those assigned to elements of the waveguide converter 1 according to the first embodiment illustrated in FIG. 2 and FIG. 3 are assigned to the corresponding elements of the waveguide converter 4 according to the second embodiment illustrated in FIG. 27 and FIG. 28.

The waveguide converter 4 of FIG. 27 and FIG. 28 has the conductor patch 25B within the opening 27B of the circuit board 20.

As illustrated in FIG. 27 and FIG. 28, the conductor patch 25B according to the second embodiment includes a rectangular section 25Br and a protruding portion 25Bc. The rectangular section 25Br is a rectangular-shaped portion of the conductor patch 25B. The protruding portion 25Bc is a protruding-shaped portion of the conductor patch 25B.

The rectangular section 25Br has short sides in the direction parallel with the transmission direction of a signal on the signal line 24, and has long sides in the direction orthogonal to the transmission direction of that signal. In other words, the rectangular section 25Br has short sides in the same direction as that of the short sides of the hollow section 11 of the waveguide 10, and has long sides in the same direction as that of the long sides of the hollow section 11.

As illustrated in FIG. 27 and FIG. 28, the protruding portion 25Bc is provided at the center of a long side of the rectangular section 25Br other than the long side of the rectangular section 25Br that is connected to the signal line 24.

The protruding portion 25Bc having a rectangular shape is depicted in FIG. 27 and FIG. 28, but the protruding portion 25Bc may be a square or rectangle. Moreover, the shape of the protruding portion 25Bc may be polygonal or circular.

When the protruding portion 25Bc is rectangular-shaped as illustrated in FIG. 27 and FIG. 28, sides of the protruding portion 25Bc that are parallel with the short sides of the rectangular section 25Br exist. Moreover, sides of the protruding portion 25Bc that are parallel with the long sides of the rectangular section 25Br exist.

The conductor patch 25B may be arranged in such a manner that a center line that vertically divides the long sides of the rectangular section 25Br into two equal parts matches a center line that vertically divides the long sides of the opening 12 of the waveguide 10 into two equal parts. Moreover, the conductor patch 25B may be arranged in such a manner that the signal line 24 is connected onto a center line that vertically divides the long sides of the rectangular section 25Br into two equal parts.

Figure 29:
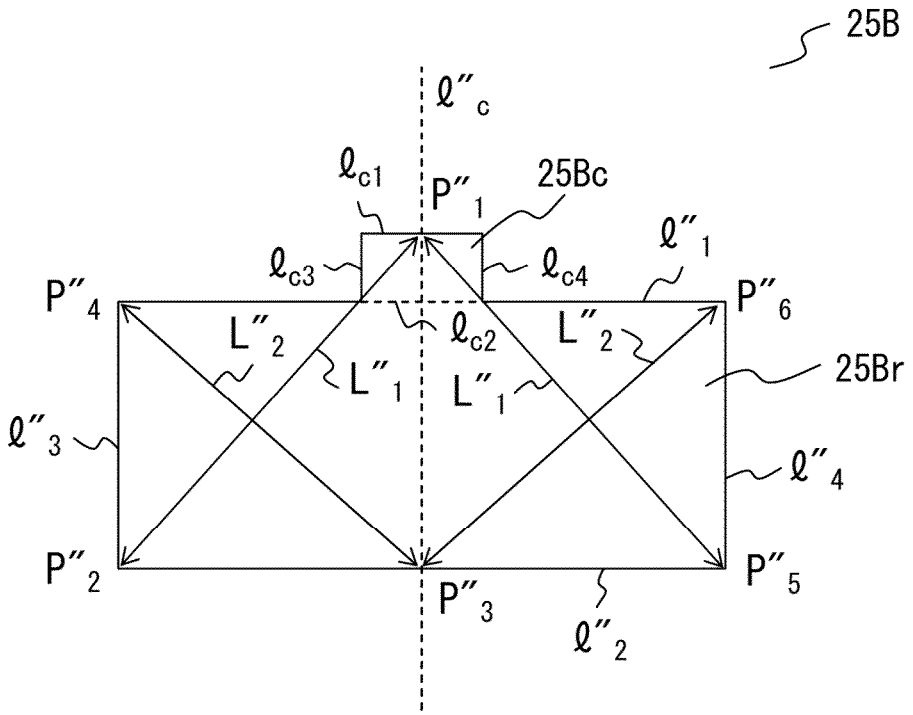
FIG. 29 is a drawing for explaining the relationship between the shape of a conductor patch according to the second embodiment and a frequency characteristic.

FIG. 29 is a drawing for explaining the relationship between the shape of a conductor patch according to the second embodiment and a frequency characteristic.

In FIG. 29, the signal line 24 is connected to a long side $l_2$" side of the rectangular section 25Br at the bottom of FIG. 29, and the conductor patch 25B is arranged within the opening 12 of the waveguide 10.

The rectangular section 25Br is provided with long sides $l_1$" and $l_2$" and short sides $l_3$" and $l_4$". The long sides $l_1$" and $l_2$" are parallel with the long sides of the waveguide 10, and the short sides $l_3$" and $l_4$" are parallel with the short sides of the waveguide 10.

The protruding portion 25Bc is arranged at the center of a long side $l_1$" of the rectangular section 25Br, which is an another long side in parallel with the long side $l_2$" that is connected to the signal line 24.

The protruding portion 25Bc includes sides $l_{c1}$-$l_{c4}$. The side $l_{c1}$ is parallel with the side $l_{c2}$, and the side $l_{c3}$ is parallel with the side $l_{c4}$.

The sides $l_{c3}$ and $l_{c4}$ of the protruding portion 25Bc exist in parallel with the short sides $l_3$" and $l_4$" of the rectangular section 25Br. The side $l_{c2}$ of the protruding portion 25Bc overlaps with the long side $l_1$" of the rectangular section 25Br, and the side $l_{c1}$ of the protruding portion 25Bc that is parallel with the side $l_{c2}$ is parallel with the long side $l_1$".

Firstly, an undesired resonance frequency in the waveguide converter 4 that includes the conductor patch 25B of FIG. 29, i.e., a resonance frequency that degrades the pass characteristic indicated by the scattering parameter S21 when it is assumed that a port 1 exists on the waveguide 10 side and a port 2 exists on the signal line 24 side, is determined according to the length of a straight line $L_1$" illustrated in FIG. 29.

The straight line $L_1$" is a straight line that is drawn from a point $P_1$" at which a center line $l_c$" that vertically divides the long sides $l_1$" and $l_2$" into two equal parts intersects with the side $l_{c1}$ of the protruding portion 25Bc that is parallel with the long side $l_1$" at the top of FIG. 29 to a point $P_2$" at which a short side $l_3$" intersects with the long side $l_2$". Also, the straight line $L_1$" is a straight line that is drawn from the intersection point $P_1$" to a point $P_5$" at which a short side $l_4$" intersects with the long side $l_2$".

Next, the center frequency of an active frequency band in the waveguide converter 4 that includes the conductor patch 25B, i.e., a resonance frequency that degrades the reflection characteristic indicated by scattering parameters S11 and S22, is determined according to the length of a straight line $L_2$".

The straight line $L_2$" is a straight line that is drawn from a point $P_3$" at which the center line $l_c$" intersects with the long side $l_2$" at the bottom of FIG. 29 to a point $P_4$" at which the long side $l_1$" at the top of FIG. 29 intersects with the short side $l_3$". Also, the straight line $L_2$" is a straight line that is drawn from the intersection point $P_3$" to a point $P_6$" at which the long side $l_1$" at the top of FIG. 29 intersects with the short side $l_4$".

As illustrated in FIG. 29, the protruding portion 25Bc is provided for the conductor patch 25B according to the second embodiment so as to touch the center of the long side $l_1$". Accordingly, it becomes possible to make the straight line L1" that determines an undesired resonance frequency be longer than the straight line L2" that determines the center frequency of an active frequency band due to the existence of the protruding portion 25Bc. When the straight line $L_1$" is made longer than the straight line $L_2$", it is possible to shift an undesired resonance frequency to a high frequency, and thus it becomes possible to keep an undesired resonance frequency away from the center frequency of an active frequency band.

Accordingly, the waveguide converter 4 that is provided with the conductor patch 25B according to the second embodiment may achieve good signal conversion performance in an active frequency band. Moreover, it is possible to secure good signal conversion performance in the active frequency band even if a pattern misalignment is caused when a waveguide converter is manufactured because it is possible to keep an undesired resonance frequency away from the center frequency of an active frequency band.

Furthermore, the conductor patch 25B according to the second embodiment is formed in such a manner that the length of the short sides and long sides of the rectangular section 25Br excluding the protruding portion 25Bc becomes shorter than the length of the short sides and long sides of the conductor patch 25*r* of FIG. 4. In other words, when the center frequency of an active frequency band is the same between the waveguide converter 4 provided with the conductor patch 25B and the waveguide converter provided with the conductor patch 25*r*, the long sides $l_1$" and $l_2$" are shorter than the long sides $l_1$ and $l_2$, the short sides $l_3$" and $l_4$" are shorter than the short sides $l_3$ and $l_4$, and the size of the rectangular section 25Br is smaller than the size of the conductor patch 25*r*. The center frequency of an active frequency band is moved as the shape of a conductor patch becomes no longer rectangular due to the provision of the protruding portion 25Bc, and thus it becomes necessary to adjust the length of $L_2$'. For this reason, the size of the conductor patch 25B is smaller than the size of the conductor patch 25*r* as described above.

As described above in the first embodiment, the shape and size of the conductor patch 25B according to the second embodiment may be determined by using an electromagnetic field simulation.

Figure 30:
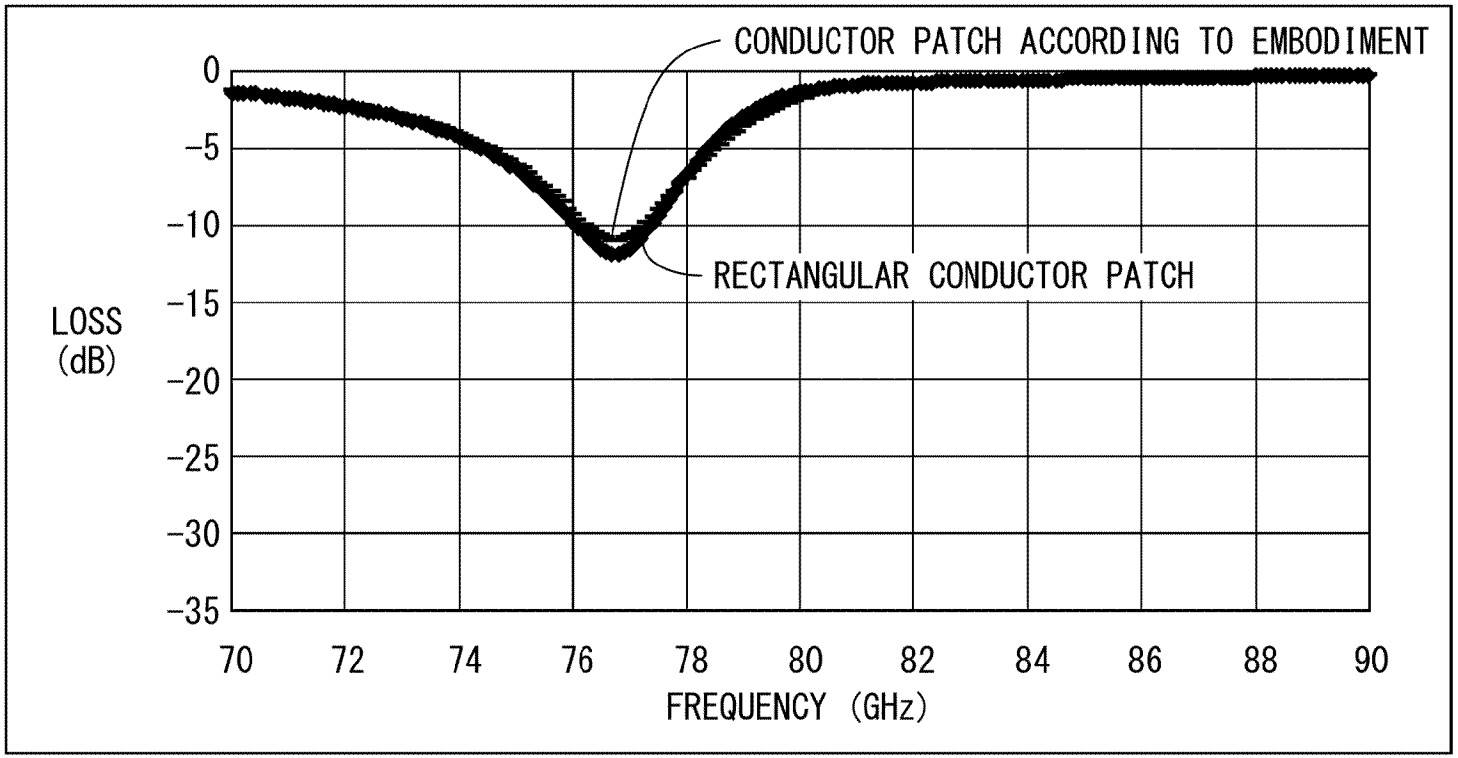
FIG. 30 depicts a simulation result of the reflection characteristic S11 of the waveguide converter that includes the conductor patch according to the second embodiment or the waveguide converter that includes a rectangular patch.
Figure 31:
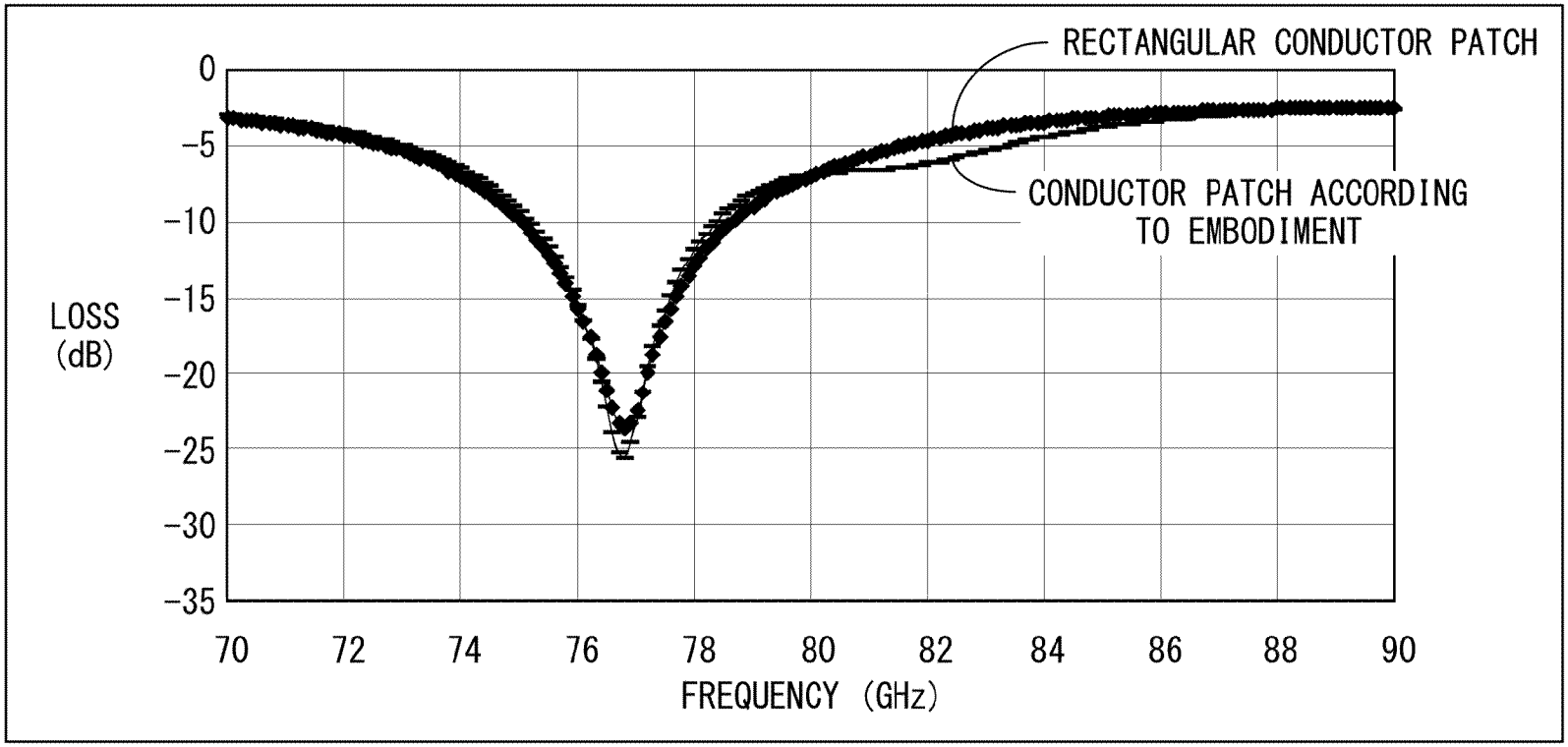
FIG. 31 depicts a simulation result of the reflection characteristic S22 of the waveguide converter that includes the conductor patch according to the second embodiment or the waveguide converter that includes a rectangular patch.
Figure 32:
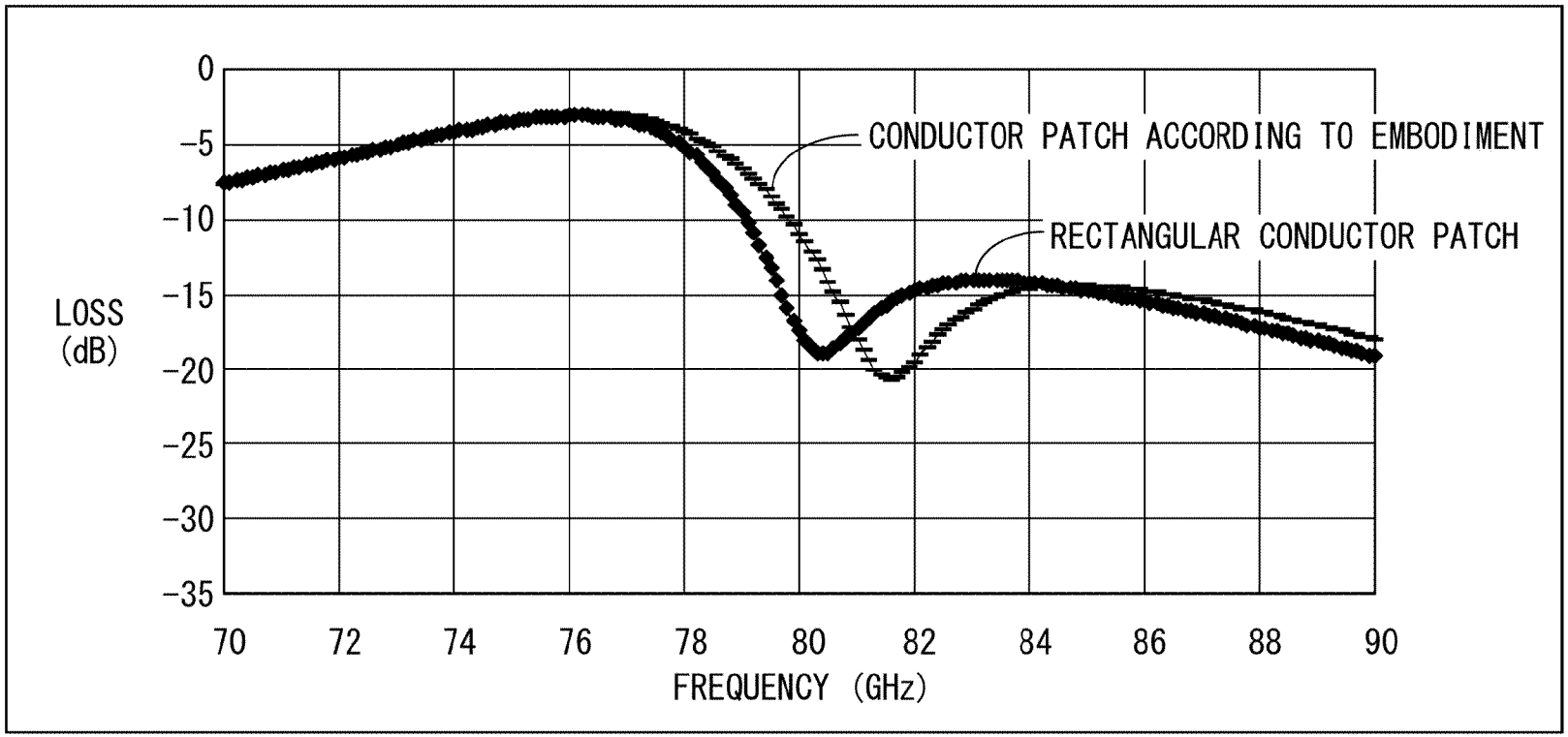
FIG. 32 depicts a simulation result of the pass characteristic S21 of the waveguide converter that includes the conductor patch according to the second embodiment or the waveguide converter that includes a rectangular patch.

An example of the result of electromagnetic field simulation in which the signal conversion performance of the waveguide converter 4 that includes the conductor patch 25B according to the second embodiment is compared with the signal conversion performance of the waveguide converter that includes the rectangular conductor patch 25*r* of FIG. 4 instead of the conductor patch 25B is depicted in FIGS. 30 to 32.

FIG. 30 depicts a simulation result of the reflection characteristic S11 of the waveguide converter that includes the conductor patch according to the second embodiment or the waveguide converter that includes a rectangular patch. FIG. 31 depicts a simulation result of the reflection characteristic S22 of the waveguide converter that includes the conductor patch according to the second embodiment or the waveguide converter that includes a rectangular patch. FIG. 32 depicts a simulation result of the pass characteristic S21 of the waveguide converter that includes the conductor patch according to the second embodiment or the waveguide converter that includes a rectangular patch.

As illustrated in FIG. 30, when the center frequency of an active frequency band, i.e., a resonance frequency of the reflection characteristic S11, is matched to 76.8 (GHz), the reflection characteristic S11 of the waveguide converter 4 that includes the conductor patch 25B according to the second embodiment may obtain almost the same frequency characteristic as the reflection characteristic of a waveguide converter that includes the rectangular conductor patch 25*r*. Moreover, as illustrated in FIG. 31, when a resonance frequency of the reflection characteristic S22 is matched to 76.8 (GHz), the reflection characteristic S22 of the waveguide converter 4 that includes conductor patch 25B according to the second embodiment may obtain almost the same frequency characteristic as the reflection characteristic of a waveguide converter that includes the rectangular conductor patch 25*r*.

Further, as illustrated in FIG. 32, when a resonance frequency of the reflection characteristic S22 is matched to 76.8 (GHz), it becomes possible for the waveguide converter 4 that includes the conductor patch 25B according to the second embodiment to keep a resonance frequency that impairs the pass characteristic S21 further away from resonance frequencies of the reflection characteristic S11 and S22 than a waveguide converter that includes the rectangular conductor patch 25*r*.

Moreover, it becomes possible for the waveguide converter 4 that includes a conductor patch 25B according to the second embodiment to further broaden a frequency band of the pass characteristic S21 where the loss becomes −8 (dB) than a waveguide converter that includes the rectangular conductor patch 25*r*.

As described above, the waveguide converter 4 that includes conductor patch 25B according to the second embodiment has a broader active frequency band that is allowed in the actual use than that of the waveguide converter that includes the rectangular conductor patch 25*r*. Moreover, the waveguide converter 4 that includes conductor patch 25B according to the second embodiment may keep a resonance frequency that degrades the pass characteristic further away from the center frequency of an active frequency band than the waveguide converter that includes the rectangular conductor patch 25*r*.

Accordingly, the waveguide converter according to the second embodiment may broaden the active frequency band at the design stage, and may keep a resonance frequency that degrades the pass characteristic away from the center frequency of an active frequency. As a result, even if a resonance frequency that degrades the pass characteristic deviates, for example, due to the variation in dimension and alignment caused when the waveguide converter is manufactured, a deterioration in the pass characteristic may be minimized, and a required signal conversion performance may be secured. As it is possible to secure a required signal conversion performance without requiring a high accuracy in manufacturing, the required accuracy in manufacturing of a waveguide converter is not necessarily very high, and a cost reduction in waveguide converters may be realized.

Further, according to the second embodiment, simulation analysis is performed as described above in regard to the first embodiment, and thereby an appropriate shape and size of the conductor patch 25B may be determined in view of not only the pass characteristic S21 but also the reflection characteristic S11 and S22.

Note that as described above, the shape and size of the conductor patch according to the second embodiment is not limited to the shape and size illustrated in FIGS. 27 to 29. For example, the shape of the protruding portion 25Bc is not necessarily rectangular, but may be polygonal or circular.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A waveguide converter comprising:

a waveguide which includes a hollow section through which a signal is transmitted and a first opening formed on a cross section of the hollow section in a direction orthogonal to a transmission direction of the signal; and a circuit board which includes on a same surface a signal line, a conductor patch connected to the signal line, and a second opening surrounding the conductor patch, the waveguide being adhered and fixed onto the circuit board in such a manner that the first opening surrounds the second opening, wherein the conductor patch includes a rectangular section, a first protruding portion and a second protruding portion, the rectangular section has short sides in a direction parallel to short sides of the first opening, and has a first long side and a second long side in a direction parallel to long sides of the first opening, the second long side being connected to the signal line, and the first and second protruding portions are provided so as to touch the short sides of the rectangular section near both ends of the second long side, respectively, a resonance frequency that degrades a pass characteristic of the signal between the waveguide and the signal line is determined using at least the length of a first straight line, the first straight line is drawn from a point at which a center line that vertically divides the first and second long sides of the rectangular section into two equal parts intersects with the first long side to a point at which a side of the first protruding portion that is parallel with the short sides of the rectangular section and that does not touch the rectangular section intersects with a side of the first protruding portion on an extension of the second long side, a center frequency of an active frequency band in the waveguide converter is determined using the length of a second straight line, the second straight line is drawn from a point at which the center line intersects with the second long side to a point at which the first long side intersects with a short side of the rectangular section, and the first straight line is longer than the second straight line.

2. The waveguide converter according to claim 1, wherein when the conductor patch is compared with a rectangular conductor patch which is included in another waveguide converter, the short sides of the rectangular section are shorter than short sides of the rectangular conductor patch, and the first and second long sides of the rectangular section are shorter than long sides of the rectangular conductor patch, and the center frequency matches another center frequency of an active frequency band provided by the another waveguide converter.

3. The waveguide converter according to claim 1, wherein the protruding portions are rectangular-shaped.

4. The waveguide converter according to claim 1, wherein when lengths of sides of the protruding portions are equal to each other and a length of a side of the conductor patch obtained by adding up the second long side and sides of the protruding portions is fixed, each of lengths of the short sides of the rectangular section, the first and second long sides, and the sides of the protruding portions is adjusted so as to optimize a reflection characteristic of the waveguide converter.

* * * * *